US011162305B2

(12) United States Patent
Massey et al.

(10) Patent No.: US 11,162,305 B2
(45) Date of Patent: Nov. 2, 2021

(54) DOWNHOLE TOOL FOR CONNECTING WITH A CONVEYANCE LINE

(71) Applicant: Impact Selector International, LLC, Heath, TX (US)

(72) Inventors: James Patrick Massey, Breckenridge, CO (US); Brandon Martin, Forney, TX (US)

(73) Assignee: Impact Selector International, LLC, Heath, TX (US)

( * ) Notice: Subject to any disclaimer, the term of this patent is extended or adjusted under 35 U.S.C. 154(b) by 119 days.

(21) Appl. No.: 16/721,828

(22) Filed: Dec. 19, 2019

(65) Prior Publication Data

US 2020/0217147 A1 Jul. 9, 2020

Related U.S. Application Data

(60) Provisional application No. 62/870,028, filed on Jul. 2, 2019, provisional application No. 62/783,045, filed on Dec. 20, 2018.

(51) Int. Cl.
*E21B 17/02* (2006.01)
*E21B 17/06* (2006.01)

(52) U.S. Cl.
CPC ..... *E21B 17/023* (2013.01); *E21B 17/028* (2013.01); *E21B 17/06* (2013.01)

(58) Field of Classification Search
CPC ..... E21B 17/023; E21B 17/028; E21B 17/06
See application file for complete search history.

(56) References Cited

U.S. PATENT DOCUMENTS 4,624,308 A 11/1986 White
4,706,744 A * 11/1987 Smith ..... E21B 17/023 166/65.1
4,880,257 A 11/1989 Holbert, Jr.
5,219,025 A 6/1993 Berger et al.
5,670,747 A 9/1997 Lawyer et al.
5,699,823 A 12/1997 Thomson
(Continued)

FOREIGN PATENT DOCUMENTS

GB 2482231 A 1/2012
WO 2019067678 A2 8/2020

OTHER PUBLICATIONS

PCT/US2019/067678 Internation Search Report and Written Opinion dated Oct. 5, 2020, 17 pages.

*Primary Examiner* — Giovanna Wright
(74) *Attorney, Agent, or Firm* — Boisbrun Hofman, PLC

(57) ABSTRACT

A downhole tool for connecting with a conveyance line. The downhole tool may include a body configured to receive the line and a fluid seal operable to seal against the line when the downhole tool is connected with the line to inhibit wellbore fluid from entering the body when the downhole tool is conveyed within a wellbore via the line. The downhole tool may include a fluid seal slidably disposed within the body and operable to seal against an inner surface of the body to inhibit wellbore fluid from entering the body when the downhole tool is conveyed within the wellbore. The body may include a first body and a second body connected together, wherein the first body is operable to move with respect to the second body when a predetermined tension is applied to the line from the wellsite surface to cause the downhole tool to release the line.

30 Claims, 14 Drawing Sheets

(56) References Cited

U.S. PATENT DOCUMENTS

| | | | | |
|---|---|---|---|---|
| 5,771,968 | A * | 6/1998 | Danciger | E21B 17/00 166/68 |
| 2004/0134667 | A1 | 7/2004 | Brewer et al. | |
| 2012/0018142 | A1 | 1/2012 | Spence | |
| 2016/0053556 | A1 | 2/2016 | Vanegas et al. | |
| 2016/0060967 | A1 | 3/2016 | Varkey et al. | |
| 2019/0109450 | A1 * | 4/2019 | Mangum | H02G 15/04 |
| 2020/0217147 | A1 | 7/2020 | Massey et al. | |

* cited by examiner

DOWNHOLE TOOL FOR CONNECTING WITH A CONVEYANCE LINE

CROSS-REFERENCE TO RELATED APPLICATIONS

This application claims priority to and the benefit of U.S. Provisional Application No. 62/783,045, titled "CABLE HEAD," filed Dec. 20, 2018, the entire disclosure of which is hereby incorporated herein by reference.

This application also claims priority to and the benefit of U.S. Provisional Application No. 62/870,028, titled "CABLE HEAD," filed Jul. 2, 2019, the entire disclosure of which is hereby incorporated herein by reference.

BACKGROUND OF THE DISCLOSURE

Wells are generally drilled into a land surface or ocean bed to recover natural deposits of oil and gas, and other natural resources that are trapped in geological formations in the Earth's crust. Testing and evaluation of completed and partially finished wells has become commonplace, such as to increase well production and return on investment. Downhole measurements of formation pressure, formation permeability, and recovery of formation fluid samples, may be useful for predicting economic value, production capacity, and production lifetime of geological formations. Furthermore, intervention operations in completed wells, such as installation, removal, or replacement of various production equipment, may also be performed as part of well repair or maintenance operations or permanent abandonment.

A tool string comprising one or more downhole tools may be deployed within the wellbore to perform such downhole operations. The tool string may be conveyed along the wellbore by applying controlled tension to the tool string from a wellsite surface via a conveyance line or other conveyance means. An upper end of the tool string may be or comprise a cable head operable to mechanically and/or electrically connect the line to the tool string. A cable head may also facilitate separation of the line from the tool string. For example, when a tool string becomes stuck within a wellbore, tension may be applied to the line to break armor wires of the line at the cable head. The line may then be removed to the wellsite surface and fishing equipment may be conveyed downhole to couple with and retrieve the stuck tool string.

A conveyance line, such as a greaseless cable, may include a smooth elastomeric sheath, which may reduce the amount of lubricant (e.g., grease) used during downhole conveyance and/or reduce the amount of friction formed against a sidewall of the wellbore during downhole conveyance. To connect such conveyance line with a cable head, the outer elastomeric sheath may be stripped from the end of the line to expose armor wires and electrical conductor(s). The armor wires may then be mechanically connected to the cable head and the electrical conductor(s) may be electrically connected with an electrical interface of the cable head, which facilitates electrical connection with the tool string.

Current cable heads permit wellbore fluid to enter therein and come into contact with the line while conveyed downhole. Because the armor wires are exposed at the end of the line, wellbore fluid can enter the line beneath the sheath. Wellbore pressure may further cause the wellbore fluid to migrate upward along the line, contaminating long portions of the line. The contaminated portions of the line have to be cut off and discarded each time the line is connected to a cable head (i.e., reheaded). Furthermore, actual strength of armor wires of a line is difficult to determine due to unknown level of metal fatigue of the armor wires and unpredictable stress concentrations experienced by the armor wire when connected to a cable head. Thus, relying on rated or otherwise expected strength of individual armor wires to control tension at which the line separates (i.e., breaks) from the cable head yields unpredictable or otherwise imprecise calculations, which may be much different from the actual tension that causes separation during downhole operations.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
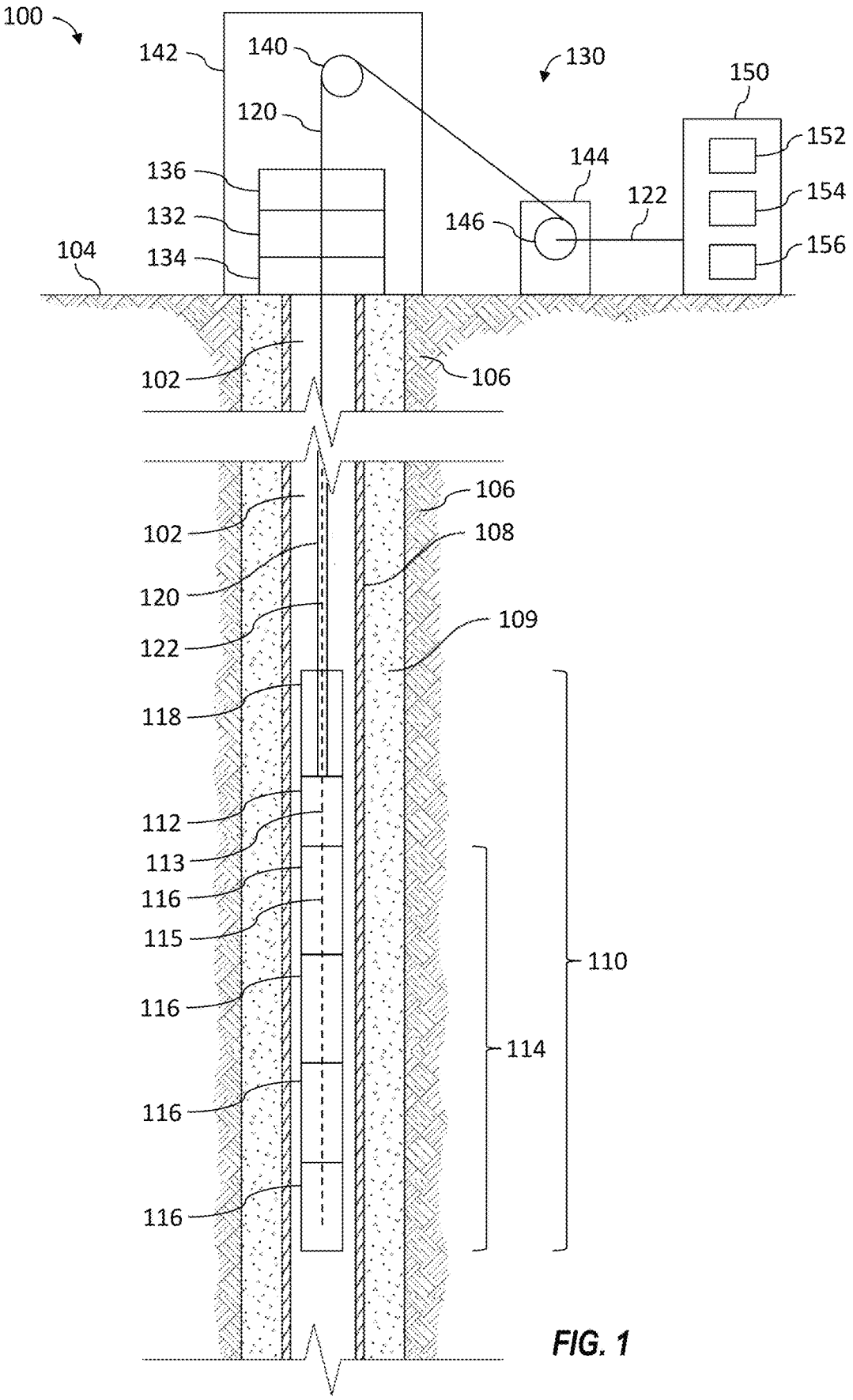
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the terms upper and upward may mean in the uphole direction, and the term lower and downward may mean in the downhole direction.

FIG. 1 is a schematic view of at least a portion of an example implementation of a wellsite system 100 according to one or more aspects of the present disclosure. The wellsite system 100 represents an example environment in which one or more aspects of the present disclosure described below may be implemented. The wellsite system 100 is depicted in relation to a wellbore 102 formed by rotary and/or directional drilling from a wellsite surface 104 and extending into a subterranean formation 106. The wellsite system 100 may be utilized to facilitate recovery of oil, gas, and/or other materials that are trapped in the subterranean formation 106 via the wellbore 102. The wellbore 102 may be a cased-hole implementation comprising a casing 108 secured by cement 109. However, one or more aspects of the present disclosure are also applicable to and/or readily adaptable for utilizing in open-hole implementations lacking the casing 108 and cement 109. It is also noted that although the wellsite system 100 is depicted as an onshore implementation, it is to be understood that the aspects described below are also generally applicable to offshore implementations.

The wellsite system 100 includes surface equipment 130 located at the wellsite surface 104 and a downhole intervention and/or sensor assembly, referred to as a tool string 110, conveyed within the wellbore 102 into one or more subterranean formations 106 via a conveyance line 120 operably coupled with one or more pieces of the surface equipment 130. The tool string 110 is shown suspended in a vertical portion of the wellbore 102, however, it is to be understood that the tool string 110 may be utilized, conveyed, or otherwise disposed within a non-vertical, horizontal, or otherwise deviated portion of the wellbore 102.

The line 120 may be operably connected with a tensioning device 140 operable to apply an adjustable tensile force to the tool string 110 via the line 120 to convey the tool string 110 along the wellbore 102. The line 120 may be or comprise a wire rope, a cable, a wireline, a multiline, an e-line, a braided line, a slickline, and/or another flexible line configured to convey the tool string 110 within the wellbore. The tensioning device 140 may be, comprise, or form at least a portion of a crane, a winch, a draw-works, an injector, and/or another lifting device coupled to the tool string 110 via the line 120. The tensioning device 140 may be supported above the wellbore 102 via a mast, a derrick, and/or another support structure 142.

Instead of or in addition to the tensioning device 140, the surface equipment 130 may comprise a winch conveyance device 144 operably connected with the line 120. The winch conveyance device 144 may comprise a reel or drum 146 configured to store thereon a wound length of the line 120. The drum 146 may be rotated to selectively wind and unwind the line 120 and/or to apply an adjustable tensile force to the tool string 110 to selectively convey the tool string 110 along the wellbore 102.

The line 120 may comprise one or more metal support wires (e.g., armor wires) configured to support the weight of the downhole tool string 110. The line 120 may also comprise one or more insulated electrical and/or optical conductors 122 operable to transmit electrical energy (i.e., electrical power) and electrical and/or optical signals (e.g., information, data) between the tool string 110 and one or more of the surface equipment 130, such as a power and control system 150. The line 120 may comprise and/or be operable in conjunction with means for communication between the tool string 110, the tensioning device 140, the winch conveyance device 144, and/or one or more other portions of the surface equipment 130, including the power and control system 150.

The wellbore 102 may be capped by a plurality (e.g., a stack) of fluid control valves, spools, fittings, and/or other devices 132 (e.g., a Christmas tree) collectively operable to control the flow of formation fluids from the wellbore 102. The fluid control devices 132 may be mounted on top of a wellhead 134, which may include a plurality of selective access valves operable to close selected tubulars or pipes, such as the production tubing and/or casing 108, extending within the wellbore 102.

The tool string 110 may be deployed into or retrieved from the wellbore 102 via the tensioning device 140 and/or winch conveyance device 144 through the fluid control devices 132, the wellhead 134, and/or a sealing and alignment assembly 136 mounted on the fluid control devices 132 and operable to seal the line 120 during deployment, conveyance, intervention, and other wellsite operations. The sealing and alignment assembly 136 may comprise a lock chamber (e.g., a lubricator, an airlock, a riser) mounted on the fluid control devices 132, a stuffing box operable to seal around the line 120 at top of the lock chamber, and return pulleys operable to guide the line 120 between the stuffing box and the surface equipment 130 connected with the line 120. The stuffing box may be operable to seal around an outer surface of the line 120, for example via annular packings applied around the surface of the line 120 and/or by injecting a fluid between the outer surfaces of the line 120 and an inner wall of the stuffing box.

The power and control system 150 (e.g., a control center) may be utilized to monitor and control various portions of the wellsite system 100 by a human wellsite operator. The power and control system 150 may be located at the wellsite surface 104 or on a structure located at the wellsite surface 104, however, the power and control system 150 may instead be located remotely from the wellsite surface 104. The power and control system 150 may include a source of electrical power 152, a memory device 154, and a surface equipment controller 156 (e.g., a processing device, a computer (PC), an industrial computer (IPC), a programmable logic controller (PLC)) operable to receive and process signals or information from the tool string 110 and/or commands from the wellsite operator. The power and control system 150 may be communicatively connected with various equipment of the wellsite system 100, such as may permit the surface equipment controller 156 to monitor operations of one or more portions of the wellsite system 100 and/or to provide control of one or more portions of the wellsite system 100, including the tool string 110, the tensioning device 140, and/or the winch conveyance device 144. The surface equipment controller 156 may include input devices for receiving commands from the wellsite operator and output devices for displaying information to the wellsite operator. The surface equipment controller 156 may store executable programs and/or instructions, including for implementing one or more aspects of methods, processes, and operations described herein.

The power and control system 150 may be communicatively and/or electrically connected with the tool string 110 via the conductor 122 extending through the line 120 and externally from the line 120 at the wellsite surface 104 via a rotatable joint or coupling (e.g., a collector) (not shown) carried by the drum 146. However, the tool string 110 may also or instead be communicatively connected with the surface controller 156 by other means, such as capacitive or inductive coupling.

The tool string 110 may comprise a cable head 112 operable to connect with the line 120. The cable head 112 may be or comprise a logging head, a line termination head or sub, a line connection head or sub, or another downhole tool operable to connect with the line 120 and a lower portion 114 of the tool string 110. The cable head 112 may physically and/or electrically connect the line 120 with or to the tool string 110, such as may permit the tool string 110 to be suspended and conveyed within the wellbore 102 via the line 120. The tool string 110 may further comprise a weight bar 118 for weighing down the tool sting 110. The weight bar 118 may be disposed or otherwise extend above (e.g., uphole from), alongside, and/or below (e.g., downhole from) the cable head 112. If the weight bar 118 extends above the cable head 112, the weight bar 118 can accommodate (e.g., receive) the line 120 therethrough via an axial bore to permit direct connection between the line 120 and the cable head 112. The weight bar 118 may be threadedly or otherwise fixedly connected with the cable head 112 or with the lower portion 114 of the tool string 110.

The cable head 112 may be operable to selectively release or otherwise disconnect from the line 120 to disconnect the tool string 110 from the line 120 while the tool string 110 is conveyed within the wellbore 102. Upon the cable head 112 releasing or disconnecting from the line 120, the line 120 can be retrieved to the wellsite surface 104 and the cable head 112, the weight bar 118, and the lower portion 114 of the tool string 110 are left in the wellbore 102. Accordingly, if a portion of the tool string 110 is stuck within the wellbore 102 and cannot be freed, the cable head 112 may be operated to release or otherwise disconnect from the line 120 such that the line 120 may be retrieved to the wellsite surface 104.

The cable head 112 may accommodate a portion of the conductor 122 and/or comprise another electrical conductor 113 electrically connected with the conductor 122. The lower portion 114 of the tool string 110 may comprise at least one electrical conductor 115 electrically connected with the electrical conductor 113. Thus, the cable head 112 and the lower portion 114 of the tool string 110 may be electrically connected with one or more components of the surface equipment 130, such as the power and control system 150, via the electrical conductors 113, 115, 122. For example, the electrical conductors 113, 115, 122 may transmit and/or receive electrical power, data, and/or control signals between the power and control system 150 and one or more of the cable head 112 and the lower portion 114. The electrical conductor 115 may further facilitate electrical communication between two or more portions of the lower portion 114. Each of the cable head 112, the lower portion 114, and/or portions thereof may comprise one or more electrical conductors, connectors, and/or interfaces, such as may form and/or electrically connect the electrical conductors 113, 115.

The lower portion 114 of the tool string 110 may comprise at least a portion of one or more downhole tools 116 (e.g., modules, subs, devices) operable in wireline, completion, production, and/or other implementations. The tools 116 of the lower portion 114 of the tool string 110 may each be or comprise one or more of an acoustic tool, a casing collar locator (CCL), a cutting tool, a density tool, a depth correlation tool, a directional tool, an electrical power module, an electromagnetic (EM) tool, a formation testing tool, a fluid sampling tool, a gamma ray (GR) tool, a gravity tool, a formation logging tool, a hydraulic power module, a magnetic resonance tool, a formation measurement tool, a jarring tool, a mechanical interface tool, a monitoring tool, a neutron tool, a nuclear tool, a perforating tool, a photoelectric factor tool, a plug, a plug setting tool, a porosity tool, a power module, a ram, a release tool, a reservoir characterization tool, a resistivity tool, a seismic tool, a stroker tool, a surveying tool, and/or a telemetry tool, among other examples also within the scope of the present disclosure.

In an example implementation of the tool string 110, a tool 116 of the tool string 110 may be or comprise a telemetry/control tool, such as may facilitate communication between the tool string 110 and the surface equipment 130 and/or control of one or more portions of the tool string 110. The telemetry/control tool may comprise a telemetry tool and/or a downhole controller (not shown) communicatively connected with the power and control system 150, including the surface controller 156, via the conductors 113, 115, 122 and with other portions of the tool string 110 via the conductors 113, 115. The downhole controller may be operable to receive, store, and/or process control commands from the power and control system 150 for controlling one or more portions of the tool string 110. The downhole controller may be further operable to store and/or communicate to the power and control system 150 signals or information generated by one or more sensors or instruments of the tool string 110.

A tool 116 of the tool string 110 may also or instead be or comprise a inclination and/or another sensor, such as one or more accelerometers, magnetometers, gyroscopic sensors (e.g., micro-electro-mechanical system (MEMS) gyros), and/or other sensors for determining the orientation of the tool string 110 relative to the wellbore 102. A tool 116 of the tool string 110 may be or comprise a depth correlation tool, such as a CCL for detecting ends of casing collars by sensing a magnetic irregularity caused by the relatively high mass of an end of a collar of the casing 108. The depth correlation tool may also or instead be or comprise a GR tool that may be utilized for depth correlation. The CCL and/or GR may be utilized to determine the position of the tool string 110 or portions thereof, such as with respect to known casing collar numbers and/or positions within the wellbore 102. Therefore, the CCL and/or GR tools may be utilized to detect and/or log the location of the tool string 110 within the wellbore 102, such as during conveyance within the wellbore 102 or other downhole operations.

A tool 116 of the tool sting 110 may also or instead be or comprise a jarring or impact tool operable to impart an impact to a stuck portion of the tool string 110 to help free the stuck portion of the tool string 110. A tool 116 of the tool sting 110 may also or instead be or comprise one or more perforating guns or tools, such as may be operable to perforate or form holes though the casing 108, the cement 109, and a portion of the formation 106 surrounding the wellbore 102 to prepare the well for production. Each perforating tool may contain one or more shaped explosive charges operable to perforate the casing 108, the cement 109, and the formation 106 upon detonation. A tool 116 of the tool string 110 may also or instead be or comprise a plug and a plug setting tool for setting the plug at a predetermined position within the wellbore 102, such as to isolate or seal a downhole portion of the wellbore 102. The plug may be permanent or retrievable, facilitating the downhole portion of the wellbore 102 to be permanently or temporarily isolated or sealed, such as during well treatment operations.

Figure 2:
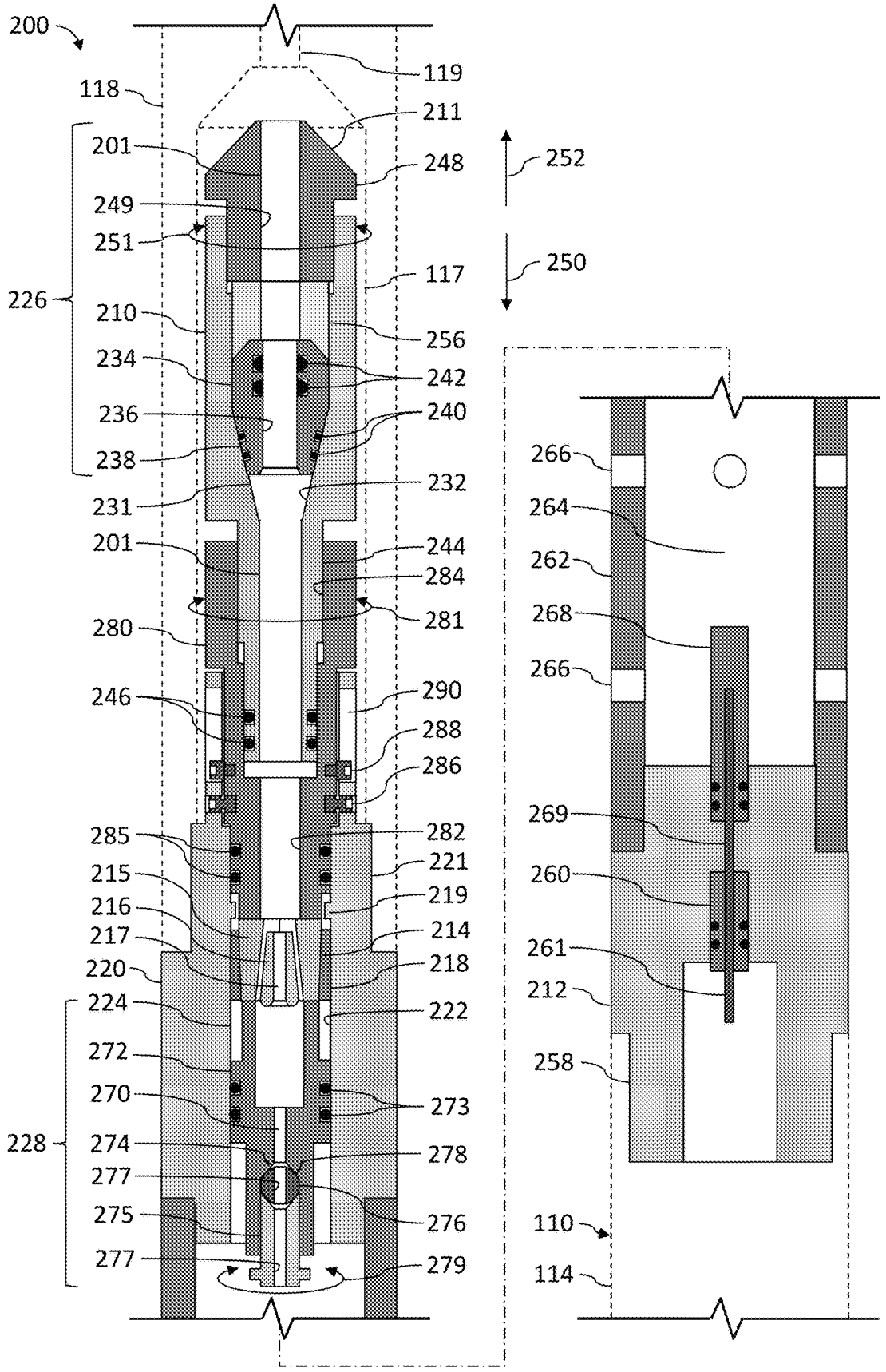
FIG. 2 is a side sectional view of at least a portion of an example implementation of apparatus according to one or more aspects of the present disclosure.

FIG. 2 is a sectional view of at least a portion of an example implementation of a cable head 200 according to one or more aspects of the present disclosure. The cable head 200 may comprise one or more features of the cable head 112 described above and shown in FIG. 1. Accordingly, the following description refers to FIGS. 1 and 2, collectively.

The cable head 200 comprises a plurality of interconnected bodies, housings, tubulars, sleeves, connectors, and other components collectively forming or otherwise defining a plurality of internal bores, spaces, and/or chambers for accommodating or otherwise containing various components of the cable head 200 and a line (e.g., line 120 shown in FIG. 1, line 202 shown in FIGS. 3 and 4) mechanically and/or electrically connected with the cable head 200. The line may be or comprise a wire rope, a cable, a wireline, a multiline, an e-line, a braided line, a slickline, and/or another flexible line configured to convey a tool string 110 within the wellbore 102. At the wellsite surface 104, the line may be mechanically connected with the tensioning device 140 and/or the winch conveyance device 144. If the line is configured to transfer data, the line may be communicatively connected with the surface controller 156. The cable head 200 may comprise an axial bore 201 extending at least partially therethrough configured to accommodate the line therein when the cable head 200 is connected with the line. The cable head 200 may comprise an upper (e.g., uphole) end 211 configured to receive the line into the bore 201 and a lower (e.g., downhole) end comprising a connector 212 (e.g., a connector sub, a crossover) operable to mechanically and/or electrically connect the cable head 200 with the lower portion 114 of the tool string 110 (both shown in phantom lines). The cable head 200 may, thus, facilitate conveyance of the tool string 110 within the wellbore 102 and/or electrical communication between the tool string 110 and the surface controller 156. The cable head 200 may be further configured to receive or otherwise connect with a weight bar 118 (shown in phantom lines). The weight bar 118 may be threadedly connected with the cable head 200 or with the lower portion 114 of the tool string 110, and may extend around and/or above at least a portion of the cable head 200. For example, the weight bar 118 may comprise an inner surface defining a chamber 117 (e.g., a larger diameter axial bore) configured to receive an upper portion of the cable head 200 and a smaller diameter axial bore 119 aligned with the cable head bore 201 and configured to accommodate the line therethrough into the cable head 200.

The cable head 200 may comprise a body assembly comprising an upper body 210 (e.g., an upper housing or sub) and a lower body 220 (e.g., a lower housing or sub) slidably disposed within and/or otherwise connected with the lower body 220. The upper body 210 may comprise an inner surface 232 defining at least a portion of the bore 201. The lower body 220 may comprise an inner surface 222 defining a chamber 224 (e.g., a bore) extending axially therethrough. The chamber 224 may be connected with the bore 201. The chamber 224 may contain a line end termination device 214 (e.g., a line end connection device, such as a wire rope socket and wedge assembly) operable to connect with (e.g., compress) armor wires (e.g., armor wires 204 shown in FIGS. 3 and 4) of the line to mechanically connect the cable head 200 with the line.

The cable head 200 may comprise an upper fluid seal assembly 226 at least partially disposed within (e.g., encompassed or surrounded by) or carried by the upper body 210. The upper fluid seal assembly 226 may define a portion of the axial bore 201 configured to receive or otherwise accommodate the line. The inner surface 232 of the upper body 210 may further define a cavity 231 containing the upper fluid seal assembly 226. The upper fluid seal assembly 226 may be configured to fluidly seal against the line when the cable head 200 is connected with the line to prevent or inhibit wellbore fluid from passing along the bore 201 into the chamber 224 containing the line end termination device 214 when the tool string 110 is conveyed within the wellbore 102 via the line. The cable head 200 may further comprise a lower fluid seal assembly 228 operatively connected with or otherwise engaging the lower body 220. The lower fluid seal assembly 228 may be configured to fluidly seal against the inner surface 222 of the lower body 220 and against an insulated electrical conductor (e.g., an electrical conductor 206 shown in FIGS. 3 and 4) of the line when the cable head 200 is connected with the line to prevent or inhibit the wellbore fluid from entering the chamber 224 containing the line end termination device 214 when the tool string 110 is conveyed within the wellbore 102 via the line. The lower body 220 may further comprise external threads 221 configured to threadedly engage internal threads (not shown) of the weight bar 118 to connect the weight bar 118 to the cable head 200. When connected with the cable head 200, the weight bar 118 may extend above the cable head 200 and receive the upper body 210 and/or a portion of the lower body 220 into the weight bar chamber 117.

A portion of the inner surface 232 forming the cavity 231 may be inwardly tapered or curved in a downward (e.g., downhole) direction. A fluid seal 234 of the upper fluid seal assembly 226 may be disposed within the cavity 231 in contact with the inwardly tapered portion of the inner surface 232 to form a fluid seal against the upper body 210. The fluid seal 234 may be configured to extend circumferentially around the line and to contact an outer surface of the line, such as an elastomeric sheath (e.g., jacket, cover, an elastomeric sheath 208 shown in FIGS. 3 and 4) of the line, to form a fluid seal against the line when the cable head 200 is connected with the line. For example, the fluid seal 234 may comprise an inner surface 236 defining a portion of the axial bore 201 configured to accommodate the line therethrough and to contact the elastomeric sheath of the line when the cable head 200 is connected with the line. The fluid seal 234 may further comprise an outer surface 238 configured to contact the inwardly tapered portion of the inner surface 232 of the upper body 210. A portion of the outer surface 238 may be inwardly tapered or curved in the downward direction or otherwise configured to contact the inwardly tapered portion of the inner surface 232. For example, at least a portion of the outer surface 238 of the fluid seal 234 may comprise a generally conical or trapezoidal geometry having an inwardly tapered outer surface configured to contact and seal against the inwardly tapered inner surface 232. However, the fluid seal 234 may instead comprise a generally spherical outer surface having an inwardly tapered outer surface configured to contact and seal against the inwardly tapered inner surface 232 of the upper body 210.

Additional one or more elastomeric fluid seals 240 (e.g., O-rings, cup seals) may be disposed between the surfaces 232, 238 to help prevent or inhibit fluid leakage between the surfaces 232, 238. Additional one or more elastomeric fluid seals 242 (e.g., O-rings, cup seals) may be disposed between the surface 236 and the outer surface of the line to help prevent or inhibit fluid leakage between the surface 236 and the line. The fluid seals 240, 242 may be retained in position within corresponding circumferential grooves or channels extending along the outer and inner surfaces 238, 236.

The upper body 210 carrying the upper fluid seal assembly 226 may be directly or indirectly connected with the lower body 220, such as to prevent or inhibit wellbore fluid from entering portions of the chamber 224 containing the line end termination device 214. A lower end of the upper body 210 may comprise external threads 244 configured to engage corresponding internal threads (not shown) of the lower body 220 or another intermediate member to connect the upper body 210 with the lower body 220. The lower end of the upper body 210 may further comprise fluid seals 246 (e.g., O-rings, cup seals) configured to engage the lower body 220 or another intermediate member to prevent or inhibit fluid leakage between the upper body 210 and the lower body 220 or another intermediate member. An intermediate sleeve 280 may be or comprise the intermediate member connecting the upper body 210 with the lower body 220. The sleeve 280 may comprise an inner surface 282 defining a portion of the bore 201. The sleeve 280 may be sealingly and/or otherwise operatively connected with both the upper body 210 and the lower body 220, as further described below.

The upper fluid seal assembly 226 may further comprise a pushing member 248 operable to selectively move axially with respect to the upper body 210, as indicated by arrows 250, 252, to selectively apply axial force (and pressure) to the fluid seal 234, thereby selectively causing the fluid seal 234 to increase and decrease contact force (and pressure) against the tapered inner surface 232 of the upper body 210 and the outer surface of the line. The pushing member 248 may comprise an inner surface 249 defining a portion of the bore 201. The pushing member 248 may be operable to push the fluid seal 234 axially along the upper body 210, as indicated by the arrow 250, to wedge the fluid seal 234 between the tapered inner surface 232 and the outer surface of the line. Thus, the pushing member 248 may impart a downward axial force, as indicated by the arrow 250, to the fluid seal 234 thereby causing the fluid seal 234 to impart corresponding radial forces against the tapered inner surface 232 of the upper body 210 and the outer surface of the line to form a fluid seal between the upper body 210 and the line. The pushing member 248 may be or comprise a threaded member (e.g., a nut, a bolt) operable to engage corresponding threads of the upper body 210 and to move axially within the cavity 231 or otherwise with respect to the upper body 210 when rotated with respect to the upper body 210, as indicated by arrows 251. The pushing member 248 may comprise, for example, external threads configured to engage corresponding internal threads of the upper body 210 and to move axially with respect to the upper body 210 when rotated with respect to the upper body 210.

The upper fluid seal assembly 226 may further comprise a spacer ring 256 located between the pushing member 248 and the fluid seal 234. The spacer ring 256 may be a selected one of a plurality of spacer rings, each having a different axial length (i.e., height), such as may permit use of fluid seals 234 having different axial lengths and/or different elastic or other mechanical properties, such as Young's modulus and bulk modulus. For example, the more elastic the fluid seal 234 is, the longer the spacer ring 256 may have to be to permit the pushing member 248 to compress the fluid seal 234 to a predetermined level.

The lower connector 212 may include a coupler, an interface, and/or other means for mechanically and/or electrically coupling the cable head 200 with corresponding mechanical and/or electrical interfaces (not shown) of the lower portion 114 of the tool string 110. The lower connector 212 may include a mechanical interface, a sub, and/or other interface means 258 for mechanically coupling the cable head 200 with a corresponding mechanical interface of a downhole tool 116 of the lower portion 114 of the tool string 110. Although the interface means 258 is shown comprising a pin coupling, the interface means 258 may be or comprise a box coupling, another threaded connector, and/or other mechanical coupling means. The lower connector 212 may further comprise an electrical interface 260 for electrically connecting the cable head 200 and, thus, the line with a corresponding electrical interface of the lower portion 114 of the tool string 110. The electrical interface of the lower portion 114 of the tool string 110 may be in electrical connection with the electrical conductor 115 of the lower portion 114. Although the electrical interface 260 is shown comprising a pin 261, the electrical interface 260 may comprise other electrical coupling means, including a receptacle, a plug, a terminal, a conduit box, and/or another electrical connector.

The lower connector 212 may be mechanically connected with the lower body 220 via an intermediate or transition housing 262 (e.g., a transition or connection hub). For example, the transition housing 262 may comprise opposing internal threads, each configured to engage corresponding external threads of the lower body 220 and of the lower connector 212 to fixedly connect the lower connector 212 with the lower body 220. The transition housing 262 may comprise or define an internal chamber 264, which may be open to the space external to the cable head 200 and, thus, the wellbore fluid when the tool string 110 is disposed within the wellbore via a plurality of openings 266 extending radially through the transition housing 262.

An electrical bulkhead connector 268 may be mechanically connected with the lower connector 212 and electrically connected with the electrical interface 260 via an electrical conductor 269 extending axially through the lower connector 212 between the electrical bulkhead connector 268 and electrical interface 260. The electrical bulkhead connector 268 may be operable to receive and connect the electrical conductor of the line with the electrical conductor 269 and, thus, the lower portion 114 of the tool string 110 via the electrical interface 260. The bulkhead connector 268 may be fluidly sealed against the lower connector 212, such as to prevent or inhibit wellbore fluid within the chamber 264 to contact the electrical conductor 269 and/or leak into the lower portion 114 of the tool string 110 when the tool string 110 is conveyed within the wellbore 102. At least a portion of the bulkhead connector 268, the electrical conductor 269, and the electrical interface 260 may collectively form the electrical conductor 113 (shown in FIG. 1), such as may facilitate electrical communication through the cable head 200.

At least a portion of the chamber 224 containing the line end termination device 214 may be fluidly isolated from the chamber 264 by the lower fluid seal assembly 228. The lower fluid seal assembly 228 may be operable to fluidly seal against the inner surface 222 of the lower body 220 and against the electrical conductor when the cable head 200 is connected with the line, thereby preventing or inhibiting the wellbore fluid within the chamber 264 from entering the portion of the chamber 224 containing the line end termination device 214 when the tool string 110 is conveyed within the wellbore 102 via the line.

The lower fluid seal assembly 228 may comprise or otherwise define an axial bore 270 extending therethrough and configured to accommodate the electrical conductor of the line therethrough when the cable head 200 is connected with the line. The lower fluid seal assembly 228 may comprise a seal retainer 272 having a generally tubular geometry comprising an inner surface 274 defining a portion of the axial bore 270. A portion of the inner surface 274 may be inwardly tapered or curved in the upward (e.g., uphole) direction. A fluid seal 276 may be disposed within the bore 270 of the retainer 272 in contact with the tapered portion of the inner surface 274 to form a fluid seal against the retainer 272. The fluid seal 276 may be configured to extend circumferentially around the electrical conductor of the line and to contact an outer surface (e.g., an elastomeric cover) of the electrical conductor to form a fluid seal against the electrical conductor when the cable head 200 is connected with the line. For example, the fluid seal 276 may comprise an inner surface 277 defining a portion of the axial bore 270 configured to accommodate the electrical conductor of the line therethrough and to contact the elastomeric sheath of the electrical conductor when the cable head 200 is connected with the line. The fluid seal 276 may further comprise an outer surface 278 configured to contact the inner surface 274 of the retainer 272. A portion of the outer surface 278 may be inwardly tapered or curved in the upward direction or otherwise configured to contact the inwardly tapered or curved portion of the inner surface 274 of the retainer 272. The fluid seal 276 may comprise a generally spherical outer surface 278. However, at least a portion of the outer surface 278 of the fluid seal 276 may instead comprise a generally conical or trapezoidal geometry having an inwardly tapered outer surface configured to contact and seal against the inwardly tapered inner surface 274 of the retainer 272. Additional one or more fluid seals (e.g., O-rings, cup seals) (not shown) may be disposed between the surfaces 274, 278 and/or between the inner surface 274 and the outer surface of the electrical conductor to help prevent or inhibit fluid leakage between the surfaces 274, 278. Such fluid seals may be retained in position within corresponding circumferential grooves or channels extending along the inner surface 274 of the retainer 272.

The lower fluid seal assembly 228 may further comprise a pushing member 275 operable to selectively move axially with respect to the retainer 272, as indicated by the arrows 250, 252, to selectively apply axial force (and pressure) to the fluid seal 276, thereby selectively causing the fluid seal to increase and decrease contact force (and pressure) against the tapered inner surface 274 of the retainer 272 and the elastomeric cover of the electrical conductor of the line. The pushing member 275 may comprise an inner surface 277 defining a portion of the bore 270. The pushing member 275 may be operable to push the fluid seal 276 axially along the retainer 272, as indicated by the arrow 252, to wedge the fluid seal 276 between the tapered inner surface 274 and the outer surface of the electrical conductor. Thus, the pushing member 275 may impart an upward axial force, as indicated by the arrow 252, to the fluid seal 276 thereby causing the fluid seal 276 to impart a corresponding radial force against the tapered inner surface 274 and the outer surface of the electrical conductor to form a fluid seal between the retainer 272 and the electrical conductor. The pushing member 275 may be or comprise a threaded member (e.g., a nut, a bolt) operable to engage corresponding threads of the retainer 272 and to move axially with respect to the retainer 272 when rotated with respect to the retainer 272, as indicated by arrows 279. The pushing member 275 may comprise, for example, external threads configured to engage corresponding internal threads of the retainer 272 and to move axially with respect to the retainer 272 when rotated with respect to the retainer 272.

The lower fluid seal assembly 228 may be directly or indirectly sealingly connected with the lower body 220, such as to prevent or inhibit wellbore fluid from entering selected portion of the chamber 224 containing the line end termination device 214. For example, the retainer 272 may be or comprise a piston slidably disposed within the chamber 224 of the lower body 220. The retainer 272 may sealingly engage the inner surface 222 of the lower body 220 thereby fluidly isolating the portion of the chamber 224 containing the line end termination device 214 from the chamber 264 and, thereby, preventing or inhibiting the wellbore fluid within the chamber 264 from entering the portion of the chamber 224 containing the line end termination device 214 when the tool string 110 is conveyed within the wellbore. One or more elastomeric fluid seals 273 (e.g., O-rings, cup seals) may be disposed between the inner surface 222 and an outer surface of the retainer 272 to help prevent or inhibit fluid leakage between the lower body 220 and the retainer 272. The fluid seals 273 may be retained in position within corresponding circumferential grooves or channels extending along the outer surface of the retainer 272.

Although the lower fluid seal assembly 228 is shown slidably engaging the lower body 220, in an example implementation of the cable head 200, the lower fluid seal assembly 228 may instead be threadedly or otherwise fixedly and sealingly connected with the lower body 220. For example, the retainer 272 may comprise external threads (not shown) configured to engage corresponding internal threads (not shown) of the lower body 220 to fixedly and sealingly engage the lower fluid seal assembly 228 with the lower body 220. Another example implementation of the cable head 200 may not comprise a separate and distinct retainer 272, but the lower body 220 may receive the fluid seal 276 and the pushing member 275. For example, the chamber 224 may not extend through a lower end of the lower body 220, and the bore 270 for receiving the electrical conductor 206, the fluid seal 276, and the pushing member 275 may extend through the lower end of the lower body 220. Another example implementation of the cable head 200 may comprise the connector 212 threadedly connected directly with the lower end of the lower body 220. Still another example implementation of the cable head 200 may comprise the lower end of the lower body 220 being connected directly with a housing or body of a tool 116 of the lower portion 114 of the tool string 110.

The line end termination device 214 may be or comprise a line end connection/disconnection device operable to connect to an end of the line 202. For example, the line end termination device 214 may comprise a plurality of conical members collectively operable to receive and compress the armor wires therebetween to mechanically connect the line end termination device 214 with the armor wires. The line end termination device 214 may be or comprise a wire rope socket and wedge assembly, comprising an outer conical member 215 (e.g., a socket) configured to accommodate therein an inner conical member 216 (e.g., a wedge). The outer conical member 215 may comprise a conical inner surface inwardly tapered or curved in the upward direction. The inner conical member 216 may comprise a conical outer surface inwardly tapered or curved in the upward direction. The inner conical member 216 may further comprise an axial bore 217 extending therethrough and configured to accommodate the conductor therethrough. The armor wires may be separated from the electrical conductor, positioned between the inner and outer conical members 216, 215, and compressed between the inner and outer conical members 216, 215 to connect the armor wires with the line end termination device 214. The conductor may be passed through the axial bore 217. The outer conical member 215 may be divided or otherwise comprise opposing lateral portions (e.g., halves, quarters) configured to be combined or brought together around the inner conical member 216 to compress the armor wires extending between the inner and outer conical members 216, 215.

A retainer ring 218 may be utilized to compress the portions of the outer conical member 215 about the inner conical member 216 to compress the armor wires located between the inner and outer conical members 216, 215. The retainer ring 218 may have an inner surface that is outwardly tapered or curved in the upward direction and the outer conical member 215 may have an outer surface that is outwardly tapered or curved in the upward direction, thereby permitting the line end termination device 214 to be wedged into the retainer ring 218 to compress the outer conical member 215 about the inner conical member 216 and the armor wires located between the inner and outer conical members 216, 215. However, instead of the line end termination device 214 being wedged into the retainer ring 218 to compress the outer conical member 215 about the inner conical member 216, the outer conical member 215 may be first disposed within the retainer ring 218 with the armor wires spread out against the inner surface of the outer conical member 215. Thereafter, the inner conical member 216 may be wedged or otherwise pushed (e.g., hammered) into the outer conical member 215 to compress the inner conical member 216 against the outer conical member 215 and the armor wires located between the inner and outer conical members 216, 215.

The retainer ring 218 may be slidable within the chamber 224, such as may permit the retainer ring 218 and the line end termination device 214 compressed therein to be slidably disposed within the chamber 224 such that the outer conical member 215 abuts lower end of the sleeve 280 (or a lower end of the upper body 210, if the sleeve 280 is not utilized). A circumferential shoulder 219 may extend radially inwards into the chamber 224 from the inner surface 222 of the lower body 220. As further described below, the shoulder 219 may prevent or block the retaining ring 218, but not the line end termination device 214, from sliding further upwardly along the chamber 224 during cable separation operations. The lower fluid seal assembly 228 may be slidably disposed within the chamber 224 such that an upper end of the retainer 272 abuts the outer conical member 215 and/or the retainer ring 218.

Although the line end termination device 214 is shown comprising two conical members 215, 216, a line end termination device comprising additional conical members may instead be utilized. For example, if a line comprising two layers of armor wires (e.g., each layer comprising different diameter armor wires) is utilized to convey the tool string 110, a line end termination device comprising three conical members may be utilized to connect such line with the cable head 200. An inner layer of armor wires may be disposed between an inner conical member 216 and an intermediate conical member, and an outer layer of armor wires may be disposed between the intermediate conical member and an outer conical member 215. The outer 215 and intermediate conical members may be divided or otherwise comprise opposing portions (e.g., halves, quarters) configured to be combined or brought together around the inner conical member 216 to compress the armor wires extending between the inner 216, intermediate, and outer 215 conical members. Similarly as described above, the retainer ring 218 may then be utilized to compress the portions of the outer 215 and intermediate conical members about the inner conical member 216 to compress the two layers of armor wires located therebetween. However, similarly as described above, the outer 215 and intermediate conical members may be first disposed within the retainer ring 218 with the outer layer of armor wires spread out against the outer conical member 218 and the inner layer of armor wires spread out against the intermediate conical member. Thereafter, the inner conical member 216 may be wedged or pushed into the intermediate conical member to compress the inner conical member 216 against the intermediate and outer 215 conical members to compress the armor wires located therebetween.

The cable head 200 may further comprise means for tensioning a portion of the line located within the cable head 200 before the cable head 200 in coupled with and supporting the weight of the lower portion 114 of the tool string 110. Such tensioning means may, thus, be referred to hereinafter as "pretensioning means." The pretensioning means may facilitate pretensioning of the line extending between the line end termination device 214 and the fluid seal 234 after the armor wires are connected with the line end termination device 214 and after the fluid seal 234 is compressed against the line. The pretensioning means may be or comprise the sleeve 280 operatively connected with or otherwise between the lower body 220 and the upper body 210, and operable to be rotated with respect to the lower body 220 and the upper body 210, as indicated by arrows 281. Upon being rotated, the sleeve 280 may move the upper body 210 upwardly with respect to the lower body 220, as indicated by the arrows 252, thereby imparting tension to the line between the fluid seal 234 and the line end termination device 214. The upper body 210 and the sleeve 280 may be threadedly connected, such that rotation of the sleeve 280 causes axial movement of the upper body 210. For example, the upper body 210 may comprise the external threads 244 configured to engage corresponding internal threads 284 of the sleeve 280, such that rotation of the sleeve 280 causes axial movement of the upper body 210, as indicated by the arrows 250, 252. The amount of tension imparted to the line by the sleeve 280 may be limited by the friction force generated between the line and the fluid seal 234 after the fluid seal 234 is compressed against the line by the pushing member 248. Accordingly, tension applied to the line may not exceed the friction force between the line and the fluid seal 234, as excessive tension may cause slippage of the fluid seal 234 with respect to the line. The fluid seals 246 may sealingly engage an inner surface of the sleeve 280 to prevent or inhibit wellbore fluid from leaking into the bore 201 between the upper body 210 and the sleeve 280.

The sleeve 280 may be rotatably connected with the lower body 220, such as may permit the sleeve 280 to rotate with respect to the lower body 220 when the line is being pretensioned. A lower portion of the sleeve 280 may be disposed within the chamber 224 of the lower body 220 and sealingly engage the inner surface 222 thereby fluidly isolating the portion of the chamber 224 containing the line end termination device 214 from the space external to the cable head 200 and, thereby, preventing or inhibiting the wellbore fluid from entering the portion of the chamber 224 containing the line end termination device 214 when the tool string 110 is conveyed within the wellbore 102. One or more elastomeric fluid seals 285 (e.g., O-rings, cup seals) may be disposed between the inner surface 222 and an outer surface of the sleeve 280 to prevent or inhibit fluid leakage between the lower body 220 and the sleeve 280. The fluid seals 285 may be retained in position within corresponding circumferential grooves or channels extending along the outer surface of the sleeve 280. The retainer ring 218 and the line end termination device 214 may be positioned (e.g., slid) within the chamber 224 until the outer conical member 215 or another portion of the line end termination device 214 abuts a lower end of the sleeve 280 (or of the upper body 210, if the sleeve 280 in not utilized) to maintain the line end termination device 214 in position with respect to the lower body 220 when tension is applied to the line.

While the tool string 110 is conveyed within the wellbore 102, a pressure differential may be formed between ambient wellbore pressure external to the cable head 200 and pressure within the fluidly isolated areas of the cable head 200 between the fluid seals 234, 276, including portions of the bore 201 below the fluid seal 234 and portions of the chamber 224 containing the line end termination device 214 above the fluid seal 276. The fluidly isolated portions of the chamber 224 and the bore 201 may be maintained at a pressure that is substantially equal to ambient wellsite surface pressure or otherwise at a pressure that is lower than the ambient wellbore pressure. Such pressure differential may cause a downward force, as indicated by the arrow 250, to be imparted to the upper body 210 and the sleeve 280 with respect to the lower body 220. The pressure differential may further cause an upward force, as indicated by the arrow 252, to be imparted to the lower fluid seal assembly 228 with respect to the lower body 220. The upward and downward forces may be imparted to the line end termination device 214 located between the sleeve 280 and the lower fluid seal assembly 228. The outer diameter of the portion of the lower fluid seal assembly 228 sealingly engaging the inner surface 222 of the lower body 220 and the outer diameter of the portion of the sleeve 280 (or of the upper body 210, if the sleeve 280 in not utilized) slidably engaging the inner surface 222 of the lower body 220 may be substantially equal, resulting in substantially equal downward and upward forces imparted to the line end termination device 214. Thus, the upward and downward forces may be equalized or balanced, such as to cancel out or negate force influences caused by wellbore pressure. Accordingly, while the tool string 110 is conveyed downhole, the lower fluid seal assembly 228, the line end termination device 214, the retaining ring 218, the sleeve 280, and the upper body 210 may collectively be free to slide within the chamber 224 or otherwise with respect to the lower body 220, but for one or more shear pins 286 (e.g., studs) connecting the sleeve 280 with the lower body 220.

The line end termination device 214 may be configured to connect the line with the cable head 200, such as may facilitate downhole conveyance and other downhole operations. The line end termination device 214 may abut the lower end of the sleeve 280 (or a lower end of the upper body 210, when the sleeve is not utilized), which prevents the line end termination device 214 from moving upwardly within the chamber 224 and out of the retainer ring 218. The line end termination device 214 transfers tension from the line to the sleeve 280 and the upper body 210. Thereby, the line end termination device 214 connects the line to the sleeve 280 and the upper body 210. The sleeve 280 may be fixedly connected with the lower body 220 via the shear pins 286 extending through the lower body 220 and into the sleeve 280. The shear pins 286 connect the sleeve 280 to the lower body 220 and, thus, transfer the line tension from the sleeve 280 to the lower body 220.

The shear pins 286 may be selected from a plurality of different shear pins, each having a different shear strength, thereby permitting determination (i.e., selection) of axial force (i.e., cable tension) at which the shear pins 286 break, and the sleeve 280 and lower body 220 separate. Because the opposing downward and upward forces imparted to the line end termination device 214 caused by the wellbore pressure substantially cancel out, such wellbore pressure generated forces may not be transferred to the shear pins 286 and, thus, may not decrease, change, or otherwise affect the amount of cable tension that is transferred to the shear pins 286.

After the shear pins 286 break (i.e., shear off), the sleeve 280 and the upper body 210 are freed to move upwardly with respect to the lower body 220, as indicated by the arrow 252, permitting the line end termination device 214 to be pulled upwardly by the line out of the retainer ring 218. The portions of the outer conical member 215 can then part or separate in a radially outward direction away from the inner conical member 216 and, thereby, permit the armor wires to be pulled out of the line end termination device 214. When the armor wires are free of the line end termination device 214, the line can be pulled upwardly through the bore 201 and the fluid seal 234, overcoming friction of the fluid seal 234, and out of the cable head 200. Accordingly, the shear pins 286 may be selected to determine cable tension at which the line separates from the cable head 200.

After the shear pins 286 break, the sleeve 280 and the upper body 210 may be maintained in connection with the lower body 220 via one or more retaining members 288 (e.g., bolts, pins, projections) fixedly connected with the sleeve 280 along slits or channels 290 extending axially along an upper portion of the lower body 220. The channels 290 may limit the upward movement 252 of the retaining members 288 and, thus, the sleeve 280, with respect to the lower body 220. Accordingly, the line end termination device 214 can exit the retainer ring 218, but the retaining members 288 prevent full or disjoined separation of the sleeve 280 and the upper body 210 from the lower body 220 when the shear pins 286 break. The shear pins 286 and/or the retaining members 288 may prevent rotation of the sleeve 280 with respect to the lower body 220, thus, the shear pins 286 and the retaining members 288 may be connected with or inserted into the sleeve 280 after the line between the fluid seal 236 and the line end termination device 214 is pretensioned via the sleeve 280.

Although the cable head 200 is shown comprising the sleeve 280 for pretensioning the line between the fluid seal 236 and the line end termination device 214, the cable head 200 may be provided without such sleeve 280 and, thus, the means to pretension the line. In such implementation of the cable head 200, a lower portion of the upper body 210 may be sealingly connected directly with the lower body 220 such that the fluid seals 246 sealingly engage the inner surface 222 of the lower body 220, and a lower end of the upper body 210 abuts the line end termination device 214 to maintain the line end termination device 214 in place during downhole conveyance and other downhole operations. In such implementation of the cable head 200, the shear pins 286 may extend through the lower body 220 into the lower portion of the upper body 210 and the retaining members 288 may be disposed within the channels 290 and connected with the lower portion of the upper body 210.

Figure 3:
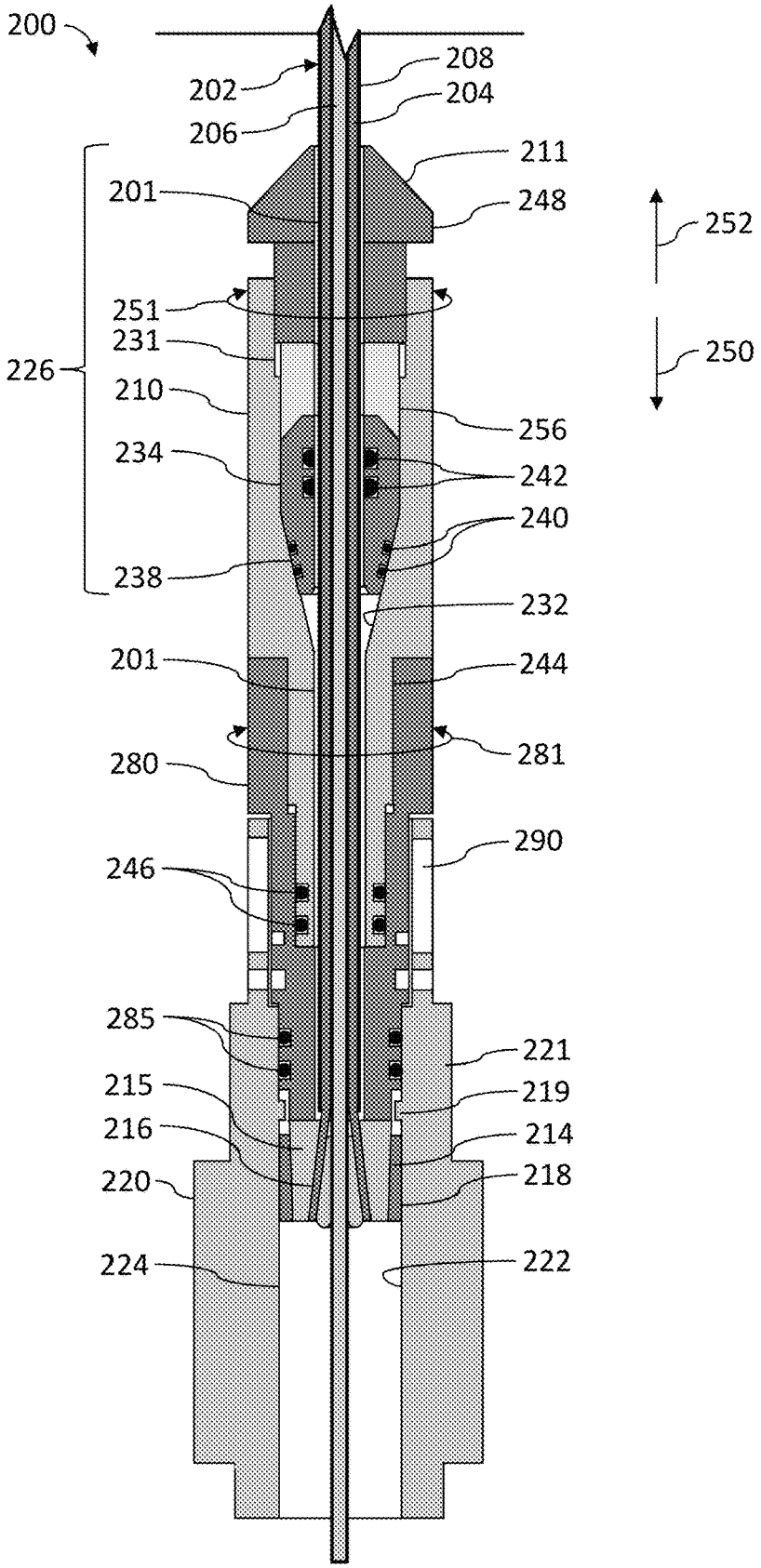
FIG. 3 is a side sectional view of the apparatus shown in FIG. 2 in a stage of operations according to one or more aspects of the present disclosure.
Figure 4:
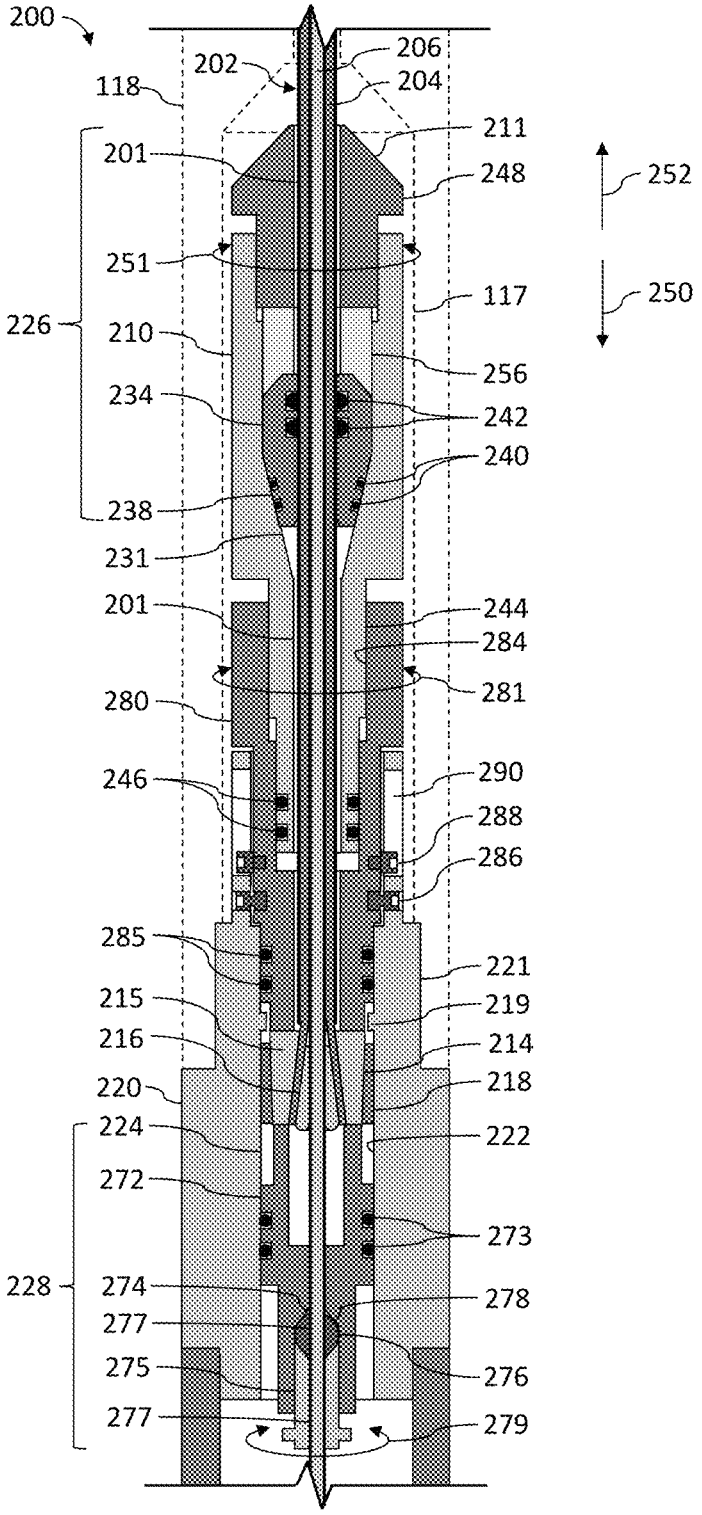
FIG. 4 is a side sectional view of the apparatus shown in FIG. 3 in another stage of operations according to one or more aspects of the present disclosure.
Figure 5:
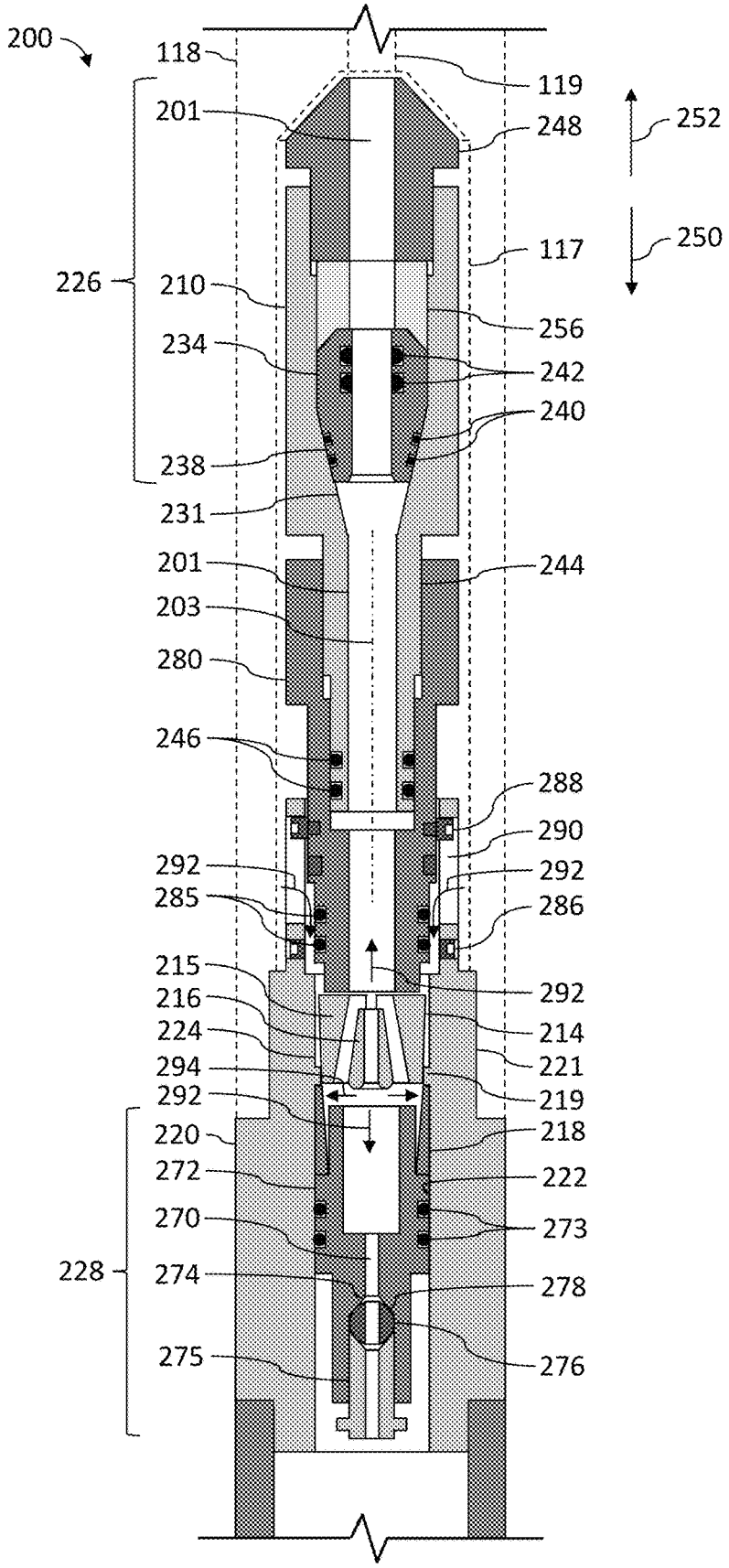
FIG. 5 is a side sectional view of the apparatus shown in FIG. 4 in another stage of operations according to one or more aspects of the present disclosure.

The present disclosure is further directed to methods (e.g., operations, processes) of assembling and operating the cable head 200. FIGS. 3-5 are sectional side views of the cable head 200 shown in FIG. 2 in various stages of assembly and downhole operations according to one or more aspects of the present disclosure.

Referring now to FIGS. 1-3, the cable head 200 may be assembled via a plurality of steps. The cable head 200 may be assembled, for example, by inserting the fluid seal 234, the spacer ring 256, and the pushing member 248 into the cavity 231 of the upper body 210. The upper body 210 may then be threadedly connected with the sleeve 280, and the sleeve 280 may be inserted into the chamber 224 of the lower body 220. The line 202 may then be passed through the bore 119 of the weight bar 118, through the bore 201 of the cable head 200, and through the chamber 224 of the lower body 220. The sheath 208 at the end of the line 202 may be stripped, thereby exposing the armor wires 204, which may then be distributed against an inner surface of the outer conical member 215 of the line end termination device 214, and the electrical conductor 206 may be passed through the axial bore 217 of the inner conical member 216. The inner conical member 216 may then be moved into the outer conical member 215 and the retainer ring 218 may be forced over the outer conical member 215 to compress the armor wires 204 between the inner and outer conical members 216, 215, thereby connecting the armor wires 204 to the line end termination device 214. The armor wires 204 may instead be connected with the line end termination device 214 by first placing the portions of the outer conical member 216 within the retainer ring 218, inserting the exposed armor wires 204 within the outer conical member 216, and laying out the armor wires 204 against the inner surface of the outer conical member 216. If an intermediate conical member is used for a line having two layers of armor wires, then the intermediate conical member may be inserted into the outer conical member 216 and an inner layer of the armor wires may be laid out against the inner surface of the intermediate conical member. Thereafter, the inner conical member 216 may be inserted over the electrical conductor and into the outer conical member 215 or into the intermediate conical member, if utilized. The inner conical member 216 may then be wedged or otherwise forced (e.g., hammered) further into the outer 215 or intermediate conical members to compress the armor wires. The line 202 may be pulled upwardly through the bore 201 thereby pulling the line end termination device 214 and the retainer ring 218 into chamber 224 until the line end termination device 214 abuts the lower end of the sleeve 280 and the retainer ring 218 abuts or is close to the shoulder 219.

As further shown in FIG. 4, the end of the line 202 comprising the exposed armor wires 204 connected to the line end termination device 214 may be fluidly sealed within the chamber 224 via the sealing assemblies 226, 228. For example, when the line end termination device 214 abuts the sleeve 280, the pushing member 248 may be rotated, as indicated by the arrow 251, to push the spacer ring 256 and the fluid seal 234 downwardly along the upper body 210, as indicated by the arrow 250, to wedge the fluid seal 234 between the tapered inner surface 232 and the outer surface of the line 202, thereby forming a fluid seal therebetween. The pushing member 248 may, thus, impart a downward axial force, as indicated by the arrow 250, to the fluid seal 234 thereby causing the fluid seal 234 to impart a corresponding radial force against the tapered inner surface 232 and the outer surface of the line 202 to form a fluid seal therebetween, thereby preventing or inhibiting wellbore fluid from flowing along the bore 201 toward the line end termination device 214 and the end of the line 202 comprising the exposed armor wires 204. The fluid seals 246, 285 may form a fluid seal between the upper body 210, the sleeve 280, and the lower body 220, preventing or inhibiting wellbore fluid from flowing into the bore 201 between the fluid seal 234 and the line end termination device 214.

After the fluid seal 234 is compressed (e.g., swaged) against the line 202 thereby forming the fluid seal, a portion of the line 202 extending between the fluid seal 234 and the line end termination device 214 may be pretensioned by rotating the sleeve 280, as indicated by the arrow 281, with respect to the lower body 220 and the upper body 210. Upon being rotated, the sleeve 280 may move the upper body 210 and the upper fluid seal assembly 226 upwardly with respect to the lower body 220, as indicated by the arrow 252, thereby stretching and imparting tension to the line 202 between the fluid seal 234 and the line end termination device 214. A predetermined tension may be achieved by torqueing 281 the sleeve 280 to predetermined level corresponding to the predetermined tension. After the predetermined tension is achieved, the retaining members 288 may be inserted through the channels 290 and into corresponding holes in the sleeve 280, thereby slidably connecting the lower body 220 with the sleeve 280 and the upper body 210. The shear pins 286 may be selected based on tension at which separation between the line 202 and cable head 200 is intended and then inserted into corresponding holes through the lower body 220 and sleeve 280, thereby fixedly connecting the lower body 220 with the sleeve 280 and the upper body 210. After the line 202 is pretensioned and after the shear pins 286 and retaining members 288 are inserted, the weight bar 118 may be slid along the line 202 against the threads 221. The weight bar 118 may then be threadedly connected to the cable head 200.

The lower fluid seal assembly 228 may be inserted into the chamber 224 until the seal retainer 272 abuts the line end termination device 214 while the conductor 206 is passed through the bore 270 of the lower fluid seal assembly 228. The pushing member 275 may then be rotated, as indicated by the arrow 279, to push the fluid seal 276 upwardly along the retainer 272, as indicated by the arrow 252, to wedge the fluid seal 276 between the tapered inner surface 274 and the outer surface of the electrical conductor 206, thereby forming a fluid seal therebetween. The pushing member 275 may, thus, impart an upward axial force to the fluid seal 276 thereby causing the fluid seal 276 to impart a corresponding radial force against the tapered inner surface 274 and the outer surface of the electrical conductor 206 to form a fluid seal therebetween, preventing or inhibiting the wellbore fluid from flowing along the bore 270 toward the line end termination device 214 and the end of the line 202 comprising the exposed armor wires 204. The fluid seals 273 may form a fluid seal between the inner surface 222 of the lower body 220 and the seal retainer 272, preventing or inhibiting wellbore fluid from flowing along the chamber 224 toward the line end termination device 214 and the end of the line 202.

Thereafter, the conductor 206 may be electrically connected with the electrical bulkhead connector 268 of the lower connector 212, and the transition housing 262 may be connected with the lower body 220 and the lower connector 212, thereby fixedly connecting the lower connector 212 with the lower body 220. The lower portion 114 of the tool string 110 may then be connected to the lower connector 212.

The assembled tool string 110 may be conveyed within the wellbore 102 and caused to perform intended operations via various downhole tools 116 forming the tool string 110. While conveyed downhole, the upper fluid seal assembly 226 may prevent or inhibit wellbore fluid from leaking along the bore 201 below the fluid seal 234 and into the chamber 224 toward the end of the line 202 connected with the line end termination device 214. Similarly, the lower fluid seal assembly 228 may prevent or inhibit wellbore fluid from leaking upwardly into a portion of the chamber 224 above the fluid seal 273 and along the bore 270 above the fluid seal 276 toward the end of the line 202 connected with the line end termination device 214. Thus, the cable head 200 shown in FIG. 4 is in a connected or normal stage or position, in which the cable head 200 is utilized to transmit tension generated by the tensioning device 140 and/or winch conveyance device 144 at the wellsite surface 104 to the tool string 110, such as during downhole measuring, logging, and/or conveyance of the tool string 110.

When it is intended to disconnect the tool string 110 from the line 202, such as when the tool string 110 is stuck within the wellbore 102, thereby permitting the line 202 to be retrieved to the wellsite surface 104, the cable head 200 may be operated to release the line 202 from the cable head 200. The cable head 200 may progress though a sequence of stages or positions during such release operations. FIG. 5 shows the cable head 200 in a released or operated stage or position, in which the line 202 is released by and pulled out of the cable head 200, thereby permitting the line 202 to be retrieved to the wellsite surface 104.

To initiate the release operations to release the line 202 by the cable head 200, the tensioning device 140 and/or winch conveyance device 144 at the wellsite surface 104 may be operated to impart a tension to the line 202 that exceeds the collective strength of the shear pins 286, thereby shearing (i.e., breaking) the shear pins 286 and permitting the line 202 to be released by the cable head 200. Namely, the tension applied to the line 202 may be transferred to the line end termination device 214, thereby urging the line end termination device 214 to move in the upward direction, as indicated by the arrow 252. The line end termination device 214, in turn, may push the sleeve 280 in the upward direction with respect to the lower body 220, thereby imparting shear stress to the shear pins 286. When sufficient tension is applied by the tensioning device 140 and/or winch conveyance device 144, the shear pins 286 break, permitting the line end termination device 214, the sleeve 280, and the upper body 210 to move upwardly with respect to the lower body 220, as indicated by the arrow 252. The sleeve 280 and the upper body 210 may be permitted to move upwardly until the retaining members 288 reach an upper end of the channels 290. The retaining members 288 maintain physical connection between the lower body 220 and the sleeve 280 connected with the upper body 210 after the shear pins 286 break.

When the fluid seals 285 and/or the lower end of the sleeve 280 move upwardly within the chamber 224 until the fluid seals 285 no longer seal against the inner surface 222 of the lower body 220, wellbore fluid may enter the previously sealed portions of the chamber 224 and bore 201 via a fluid pathway between the sleeve 280 and the lower body 220, as indicated by arrows 292, thereby equalizing the lower pressure within the cable head 200, maintained by the fluid seals 234, 246, 273, 276, 285, with the higher ambient wellbore fluid pressure external to the cable head 200. While the line end termination device 214 is pulled upwardly by the line 202, the shoulder 219 may prevent the retainer ring 218 from moving upwardly, causing the line end termination device 214 to be pulled or otherwise moved out of the retainer ring 218. After the line end termination device 214 is substantially moved out of the retainer ring 218, the portions of the outer conical member 215 may be free to separate from the inner conical member 216 in a radially outward direction with respect to a central axis 203 of the cable head 200, as indicated by arrows 294, uncompressing or otherwise relieving the compression applied to the armor wires 204. With the pressure differential between the wellbore and the chamber 224 and bore 201 equalized (or relieved), the line 202 may be free to be pulled or otherwise moved upwardly to pull the armor wires 204 out of the line end termination device 214. The line 202 may then be pulled through the bore 201, overcoming the friction against the fluid seal 234, and out of the cable head 200.

The line 202 may then be retrieved to the wellsite surface 104. Fishing equipment (not shown) may then be deployed downhole and coupled or otherwise engaged with the tool string 110 left in the wellbore 102, such as may permit fishing operations to be employed to free the tool string 110. The fishing equipment may engage a neck, a profile, or an outer surface of the weight bar, the cable head 200, and/or a portion of the lower portion 114 of the tool string 110.

Figure 6:
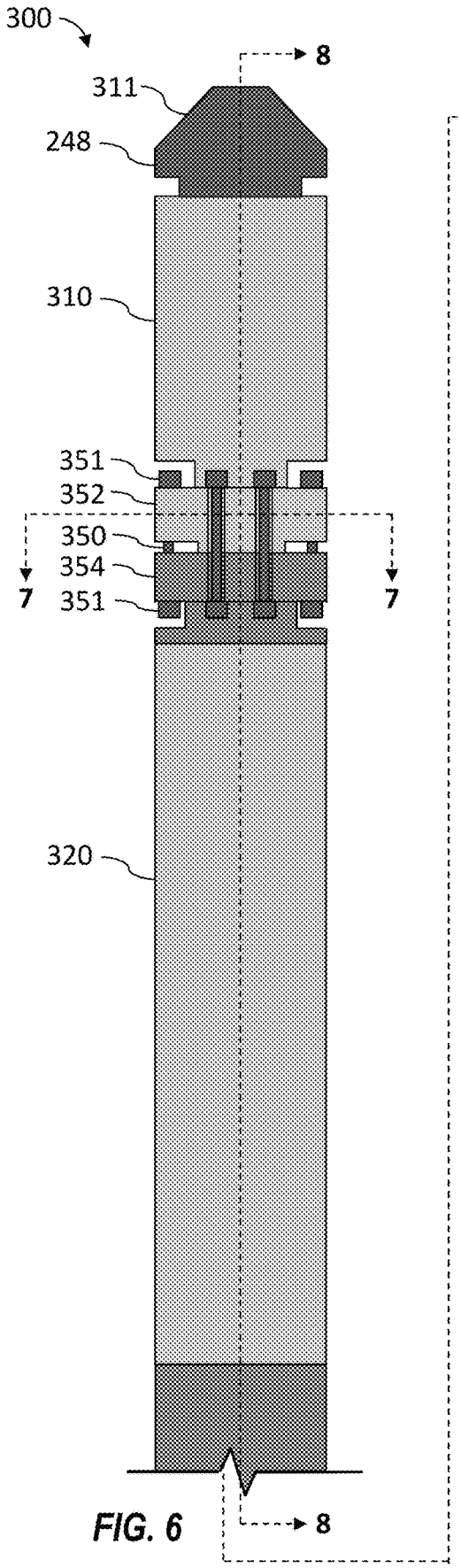
FIG. 6 is a side view of at least a portion of an example implementation of apparatus according to one or more aspects of the present disclosure.
Figure 7:
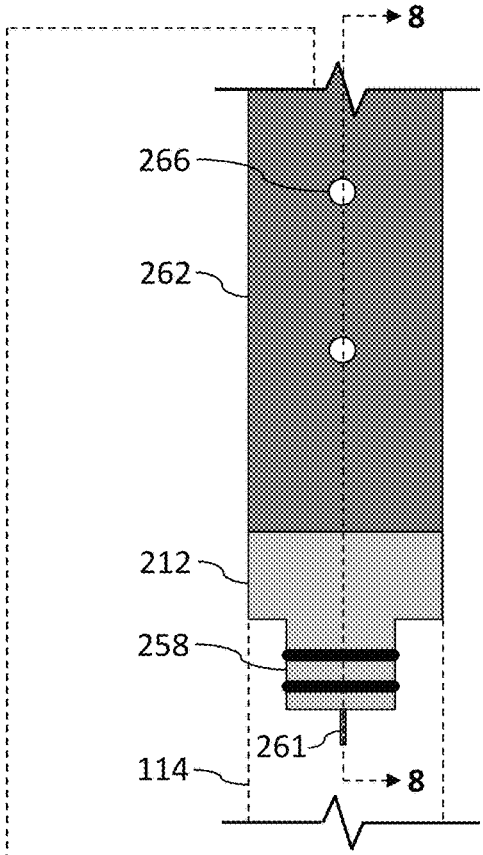
FIG. 7 is an axial sectional view of the apparatus shown in FIG. 6.
Figure 7:
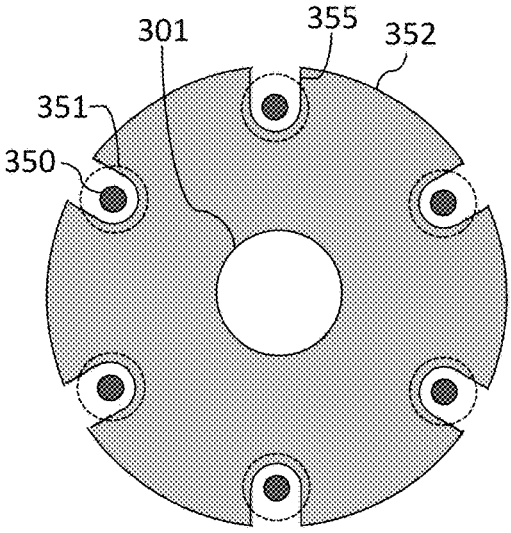
Figure 8:
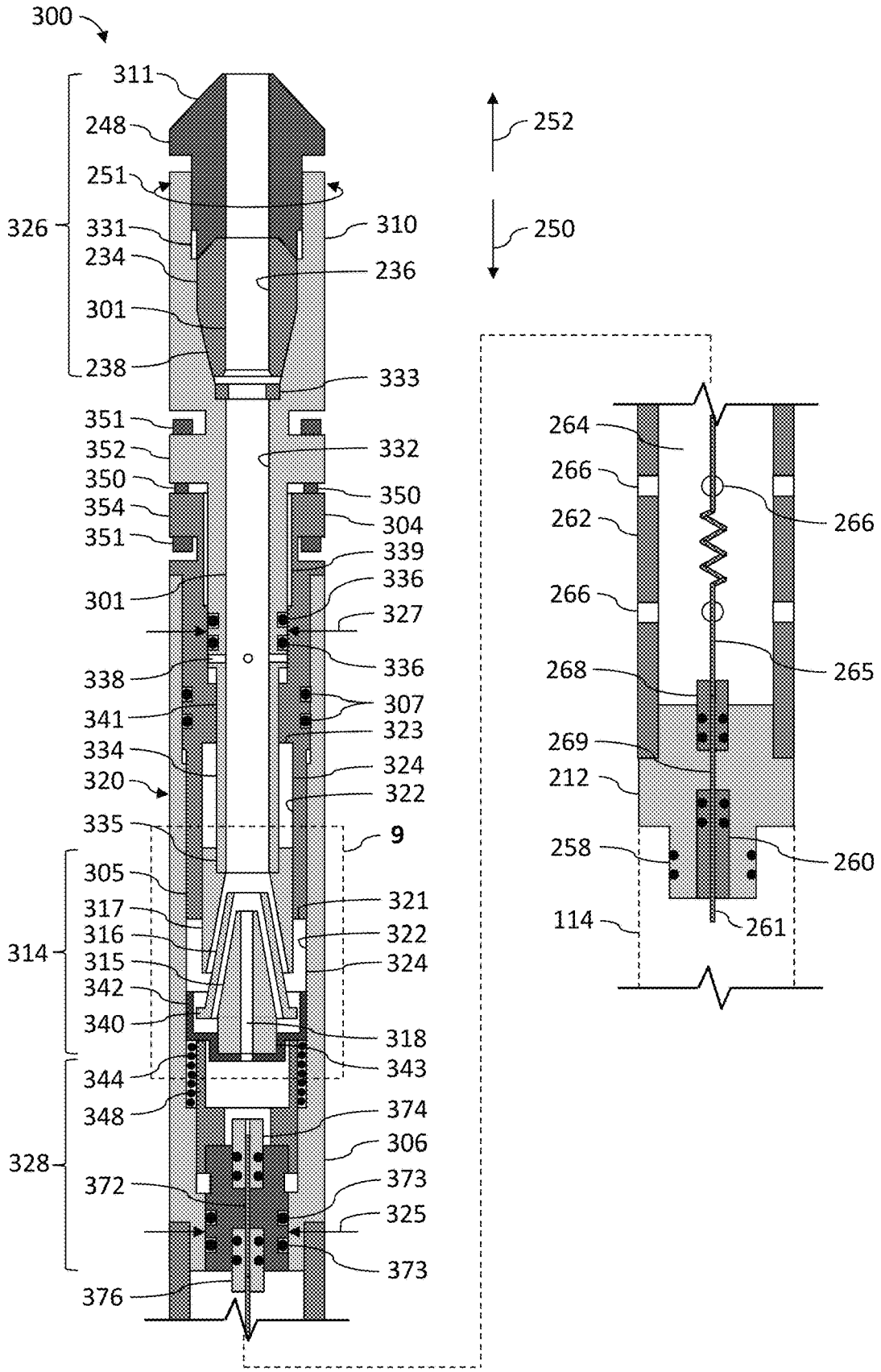
FIG. 8 is side sectional view of the apparatus shown in FIG. 6.
Figure 9:
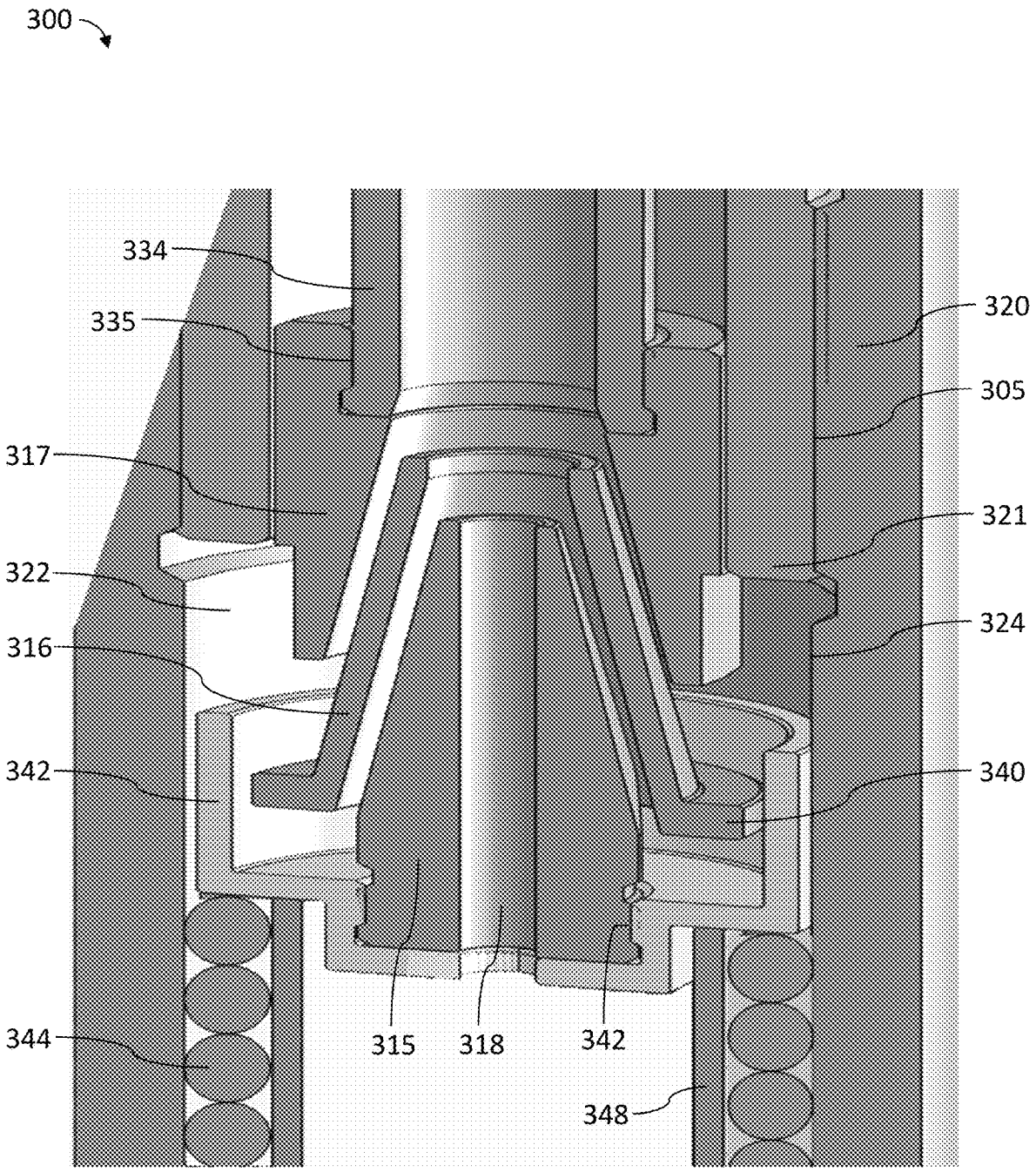
FIG. 9 is a close-up view of a portion of the apparatus shown in FIG. 8.

FIG. 6 is a side view of at least a portion of another example implementation of a cable head 300 according to one or more aspects of the present disclosure. FIG. 7 is an axial sectional view of the cable head 300 shown in FIG. 6. FIG. 8 is a side sectional view of the cable head 300 shown in FIG. 6. FIG. 9 is a close-up perspective view of a portion of the cable head 300 shown in FIG. 8. The cable head 300 may comprise one or more features of the cable heads 112, 200 described above and shown in FIGS. 1-5, including where indicated by the same reference numerals. The following description refers to FIGS. 1 and 6-9, collectively.

The cable head 300 comprises a plurality of interconnected bodies, housings, tubulars, sleeves, connectors, and other components collectively forming or otherwise defining a plurality of internal bores, spaces, and/or chambers for accommodating or otherwise containing various components of the cable head 300 and a line mechanically and/or electrically connected with the cable head 300. The line is not shown in FIGS. 6-9 for clarity, but may be or comprise the line 120 shown in FIG. 1 or the line 202 shown in FIGS. 3 and 4. The line may be or comprise a wire rope, a cable, a wireline, a multiline, an e-line, a braided line, a slickline, and/or another flexible line configured to convey a tool string 110 within the wellbore 102. The line may comprise an outer cover or sheath covering armor wires, or the line may not comprise an outer cover or sheath, whereby the armor wires are exposed. The line may comprise one or more electrical conductors covered by armor wires, or the line may comprise armor wires, but no electrical conductors. At the wellsite surface 104, the line may be mechanically connected with the tensioning device 140 and/or winch conveyance device 144 and communicatively connected with the surface controller 156. The cable head 300 may comprise an axial bore 301 extending axially at least partially through the cable head 300 and configured to accommodate the line therein when the cable head 300 is connected with the line. The cable head 300 may comprise an upper (e.g., uphole) end 311 configured to receive the line into the bore 301 and a lower (e.g., downhole) end comprising a lower connector 212 (e.g., a crossover) operable to mechanically and/or electrically connect the cable head 300 with the lower portion 114 of the tool string 110. The cable head 300 may, thus, facilitate conveyance of the tool string 110 within the wellbore 102 and/or electrical communication between the tool string 110 and the surface controller 156. At least a portion of the cable head 300 may be further configured to extend through, be received into, or otherwise connect with a weight bar, such as the weight bar 118 shown in FIGS. 1-5. The weight bar may extend around at least a portion of the cable head 300.

The cable head 300 may further comprise a body assembly comprising a lower body 320 (e.g., a lower housing or sub) and an upper body 310 (e.g., an upper housing or sub) telescopically, slidably, and/or otherwise operatively connected with the lower body 320. The upper and lower bodies 310, 320 may each have a generally tubular geometry. The upper body 310 may be telescopically or otherwise slidably disposed at least partially within the lower body 320. The upper body 310 may be operable to connect with the line and the lower body 320 may be operable to connect with the lower portion 114 of the tool string 111. The upper body 310 may be operable to move with respect to the lower body when a predetermined tension is applied to the line from the wellsite surface 104 by the tensioning device 140 and/or winch conveyance device 144 to cause the cable head 300 to release the line.

The lower body 320 may comprise a plurality of bodies, housings, and/or sleeves fixedly connected together and configured to move as single unit. For example, the lower body 320 may comprise a lower body portion 304 and a lower body portion 306 fixedly (e.g., threadedly) connected together and configured to move as single unit and not to move with respect to each other. The lower body portion 304 may be partially disposed within the lower body portion 306. The lower body portions 304, 306 may be fixedly connected via corresponding threads 305 of the lower body portions 304, 306. Fluid seals 307 (e.g., O-rings, cup seals) may be disposed between the lower body portions 304, 306 to prevent or inhibit fluid leakage between the lower body portions 304, 306.

The lower body 320 may further comprise external threads (e.g., the threads 221 shown in FIG. 2) configured to threadedly engage internal threads of a weight bar (e.g., the weight bar 118 shown in FIG. 2) to connect the weight bar to the cable head 300. When connected with the cable head 300, the weight bar may extend above the cable head 300 and receive the upper body 310 and/or a portion of the lower body 320 into a weight bar chamber.

The upper body 310 may define the upper end 311 of the cable head 300 and may comprise an inner surface 332 defining at least a portion of the bore 301 configured to receive the line. The lower body 320 may comprise an inner surface 322 defining a chamber 324 (e.g., a bore) extending axially therethrough. The chamber 324 may be connected with the bore 301. The chamber 324 may contain a line end termination device 314 (e.g., a line end connection device, such as a wire rope socket and wedge assembly) operable to connect with (e.g., compress) armor wires (e.g., the armor wires 204 shown in FIGS. 3 and 4) of the line to mechanically connect the cable head 300 with the line.

The upper body 310 may comprise a lower portion 334 (e.g., a tubular member) telescopically or otherwise slidably disposed within or extending into the chamber 324 of the lower body 320 and sealingly engaging the inner surface 322 of the lower body 320. The lower portion 334 may comprise a piston portion 345 (or a sealing portion) operable to sealingly engage the inner surface 322 of the lower body 320 to fluidly isolate the portion of the chamber 324 containing the line end termination device 314 from the space external to the cable head 300 and, thus, prevent or inhibit the wellbore fluid from entering the portion of the chamber 324 containing the line end termination device 314 when the tool string 110 is conveyed within the wellbore 102. One or more elastomeric fluid seals 336 (e.g., O-rings, cup seals) may be disposed between the inner surface 322 and an outer surface of the piston portion 345 to prevent or inhibit fluid leakage between the upper and lower bodies 310, 320. The fluid seals 336 may be retained in position within corresponding circumferential grooves or channels extending along the lower portion 334 of the upper body 310. The lower portion 334 may comprise a plurality of fluid ports 338 extending radially therethrough between the inner surface 332 (or the bore 301) and the outer surface of the lower portion 334. The inner surface 322 of the lower body 320 may comprise a larger inner diameter portion 339 extending or otherwise located above the fluid ports 338 and fluid seals 336. The lower portion 334 of the upper body 310 may comprise a smaller outer diameter portion 341 extending or otherwise located below the fluid ports 338, the fluid seals 336, and the larger inner diameter portion 339. The lower body 320 may further comprise circumferential shoulders 321, 323 extending in a radially inward direction from the inner surface 322 of the lower body 320 at different axial locations along the lower body.

The upper body 310 may be (e.g., fixedly) connected with the lower body 320 via a plurality of breakable pins 350 (e.g., studs) extending through the upper and lower bodies 310, 320. For example, the pins 350 may extend axially through or between an upper flange 352 of the upper body 310 and a lower flange 354 of the lower body 320. The pins 350 may be distributed circumferentially along or around the upper and lower flanges 352, 354 and extend through or between the upper and lower flanges 352, 354. The pins 350 may be disposed within corresponding radial channels 355 extending axially along and/or radially into both the upper and lower flanges 352, 354, such that each opposing head 351 of a pin 350 contacts (e.g., abuts, latches against) an opposing upper and lower surface (e.g., shoulder, edge) of a corresponding upper and lower flange 352, 354. The pins 350 may be or comprise tension pins selected from a plurality of different tension pins, each having a different tension strength (e.g., yield strength, breaking strength, etc.), thereby permitting predetermination (i.e., selection) of axial force (i.e., line tension) at which the pins 350 will break. After the pins 350 are broken, the line tension applied from the wellsite surface 104 can move the upper body 310 with respect to the lower body 320 to cause the cable head 300 to release the line.

The lower connector 212 may be mechanically connected with the lower body 320 via an intermediate or transition housing 262 (e.g., a transition or connection hub). For example, the transition housing 262 may comprise opposing internal threads, each configured to engage corresponding external threads of the lower body 320 and of the lower connector 212 to fixedly connect the lower connector 212 with the lower body 320. The transition housing 262 may comprise or define an internal chamber 264, which may be open to the space external to the cable head 300 and, thus, the wellbore fluid when the tool string 110 is disposed within the wellbore 102 via a plurality of openings 266 extending radially through the transition housing 262.

The lower connector 212 may be or comprise a coupler, an interface, and/or other means for mechanically and electrically coupling the cable head 300 with corresponding mechanical and electrical interfaces (not shown) of the lower portion 114 of the tool string 110. The lower connector 212 may include a mechanical interface, a sub, and/or other interface means 258 for mechanically coupling the cable head 300 with a corresponding mechanical interface of a downhole tool 116 of the lower portion 114 of the tool string 110. Although the interface means 258 is shown comprising a pin coupling, the interface means 258 may be or comprise a box coupling, another threaded connector, and/or other mechanical coupling means. The lower connector 212 may further comprise an electrical interface 260 for electrically connecting the cable head 300 and, thus, the line with a corresponding electrical interface of the lower portion 114 of the tool string 110. The electrical interface of the lower portion 114 of the tool string 110 may be in electrical connection with the electrical conductor 115 of the lower portion 114. Although the electrical interface 260 is shown comprising a pin connector 261, the electrical interface 260 may comprise other electrical coupling means, including a receptacle, a plug, a terminal, a conduit box, and/or another electrical connector.

An electrical bulkhead connector 268 may be mechanically connected with the lower connector 212 and electrically connected with the electrical interface 260 via an electrical conductor 269 extending axially through the lower connector 212 between the electrical bulkhead connector 268 and electrical interface 260. The pin connector 261 may be configured to electrically connect with a corresponding electrical connector of the lower portion 114 of the tool string 110 to electrically connect the electrical conductor 269 with the electrical conductor 115 of the lower portion 114. The bulkhead connector 268 may be fluidly sealed against the lower connector 212, such as to prevent or inhibit wellbore fluid within the chamber 264 to contact the electrical conductor 269 and/or leak into the lower portion 114 of the tool string 110 when the tool string 110 is conveyed within the wellbore 102.

The line end termination device 314 may be or comprise a line end connection/disconnection device operable to connect to an end of the line and connect the line with the upper body 310. The line end termination device 314 may be further operable to release the line and, thus, disconnect the line from the upper body 310 when a predetermined tension is applied to the line from the wellsite surface 104 by the tensioning device 140 and/or winch conveyance device 144. The line end termination device 314 may comprise a first line end termination device portion 317 and a second line end termination device portion 315, wherein the line end termination device 314 may be operable to compress the line between the first line end termination device portion 317 and the second line end termination device portion 315 to connect with the line. The first line end termination device portion 317 may be further operable to move with respect to the second line end termination device portion 315 to uncompress the line thereby releasing the line when the predetermined tension is applied to the line. When the predetermined tension is applied to the line, the tension may cause the upper body 310 to move upwardly with respect to the second body 320 thereby causing the first line end termination device portion 317 to move with respect to the second line end termination device portion 315 to release the line. The line end termination device 314 may also comprise a third line end termination device portion 316 located between the first and second line end termination device portions 317, 315, wherein the line end termination device 314 may be operable to compress the line between the first, second, and third line end termination device portions 317, 316, 315 to connect with the line. The first and third line end termination device portions 317, 316 may be further operable to move with respect to the second line end termination device portion 315 to uncompress the line thereby releasing the line when the predetermined tension is applied to the line. When the predetermined tension is applied to the line, the tension may cause the upper body 310 to move upwardly with respect to the second body 320 thereby causing the first and third line end termination device portion 317, 316 to move with respect to the second line end termination device portion 315 to release the line.

For example, the line end termination device 314 may comprise a plurality of conical or otherwise mating or complementary members collectively operable to receive and compress the line to mechanically connect the line with the line end termination device 314. The conical members may be concentrically movable with respect to each other and collectively operable to receive and compress the armor wires therebetween to mechanically connect the armor wires with the line end termination device 314. The line end termination device 314 may comprise an inner conical member 315 (e.g., a wedge), an intermediate conical member 316 (e.g., an intermediate wedge or socket), and an outer conical member 317 (e.g., a socket). The outer conical member 317 may be configured to accommodate therein the intermediate conical member 316, and the intermediate conical member 316 may be configured to accommodate therein the inner conical member 315. The outer conical member 317 may comprise a conical inner surface inwardly tapered or curved in the upward direction. The intermediate conical member 316 may comprise a conical inner and outer surfaces inwardly tapered or curved in the upward direction. The inner conical member 315 may comprise a conical outer surface inwardly tapered or curved in the upward direction and an axial bore 318 extending therethrough and configured to accommodate the conductor of the line therethrough. Outer armor wires may be separated from the electrical conductor of the line and positioned (e.g., distributed) between the intermediate and outer conical members 216, 217, the inner armor wires may be separated from the electrical conductor and positioned between the inner and intermediate conical members 215, 216, and the conductor may be passed through the axial bore 318. The conical members 215, 216, 217 may be brought together and compressed about the inner and outer armor wires to connect the line with the line end termination device 314. If the cable head 300 is intended to be connected with a line comprising one layer of armor wires, the intermediate conical member 316 may be omitted, and the armor wires may be compressed between the inner and outer conical members 315, 317.

The intermediate conical member 316 may be connected with or comprise an outer shoulder 340 (e.g., a flange) extending radially outwards from the base of the intermediate conical member 316. The inner conical member 315 may be connected with or comprise an outer shoulder 342 extending radially outwards and upwards from the base of the inner conical member 315. The outer shoulder 342 may be or comprise a circular flange, a bell housing, a hub, a bowl or another member that extends radially outwards from the base of the inner conical member 315 past the shoulder 340 of the intermediate conical member 316 and upwards, around and above the shoulder 340. The inner conical member 315 may be fixedly connected with the outer shoulder 342, such as via a threaded connection 343.

The line end termination device 314, including the outer shoulder 342, may be slidably disposed within the chamber 324. At least a portion of the line end termination device 314 may be connected to the upper body 310, such that movement of the upper body 310 with respect to the lower body 320 can cause movement of at least a portion of the line end termination device 314 with respect to the lower body 320. For example, the outer conical member 317 may be fixedly connected with the lower portion 334 of the upper body 310, such as via a threaded connection 335. A biasing member 344 (e.g., a spring) may bias the inner conical member 315 upwardly with respect to the lower body 320. The biasing member 344 may push the outer shoulder 342 to push the inner conical member 315 into the intermediate and outer conical members 316, 317 and, thus, compress the conical members 215, 216, 217 together. The biasing member 344 may maintain the conical members 215, 216, 217 compressed together around the armor wires to prevent or inhibit the conical members 215, 216, 217 from separating, such as when the cable head 300 experiences a shock during transport or other operations before the release operations.

The cable head 300 may comprise an upper fluid seal assembly 326 at least partially disposed within, encompassed by, or carried by an upper portion of the upper body 310. The inner surface 332 of the upper body 310 may further define a cavity 331 containing the upper fluid seal assembly 326, which may define a portion of the axial bore 301 configured to accommodate the line. The upper fluid seal assembly 326 may be configured to fluidly seal against the line when the cable head 300 is connected with the line to prevent or inhibit wellbore fluid from passing along the bore 301 into the chamber 324 containing the line end termination device 314 when the tool string 110 is conveyed within the wellbore 102 via the line. The cable head 300 may further comprise a lower fluid seal assembly 328 (e.g., a sealing plug) operatively connected with the lower body 320. The lower fluid seal assembly 328 may be configured to fluidly seal against the inner surface 322 of the lower body 320 to prevent or inhibit the wellbore fluid from entering the chamber 324 containing the line end termination device 314 when the tool string 110 is conveyed within the wellbore 102 via the line. At least a portion of the chamber 324 may be fluidly isolated from the chamber 264 by the lower fluid seal assembly 328, which may be located at or near a lower end of the lower body 320 and/or at or near a lower end of the chamber 324. Thus, the upper and lower fluid seal assemblies 326, 328 may be located on opposing sides of the body assembly 310, 320 and, thus, on opposing sides of the chamber 324.

A portion of the inner surface 332 defining the cavity 331 may be inwardly tapered or curved in a downward (e.g., downhole) direction. The upper fluid seal assembly 326 may further comprise a fluid seal 234 disposed within the cavity 331 in contact with the inwardly tapered portion of the inner surface 332 to form a fluid seal against the upper body 310. The fluid seal 234 may be configured to extend circumferentially around the line and to contact an outer surface of an elastomeric sheath (such as elastomeric sheath 208 shown in FIGS. 3 and 4) of the line to form a fluid seal against the line when the cable head 300 is connected with the line. For example, the fluid seal 234 may comprise an inner surface 236 defining a portion of the axial bore 301 configured to accommodate the line therethrough and to contact the elastomeric sheath (e.g., jacket, cover) of the line when the cable head 300 is connected with the line. The fluid seal 234 may further comprise an outer surface 238 configured to contact the inwardly tapered portion of the inner surface 332 of the upper body 310. A portion of the outer surface 238 may be inwardly tapered or curved in the downward direction or otherwise configured to contact the inwardly tapered portion of the inner surface 332. For example, at least a portion of the outer surface 238 of the fluid seal 234 may comprise a generally conical or trapezoidal geometry having an inwardly tapered outer surface configured to contact and seal against the inwardly tapered inner surface 332. However, the fluid seal 234 may instead comprise a generally spherical outer surface having an inwardly tapered outer surface configured to contact and seal against the inwardly tapered inner surface 332 of the upper body 310.

Additional one or more elastomeric fluid seals (e.g., O-rings, cup seals, the fluid seals 240 shown in FIG. 2) may be disposed between the surfaces 332, 238 to help prevent or inhibit fluid leakage between the surfaces 332, 238. Additional one or more elastomeric fluid seals (e.g., O-rings, cup seals, the fluid seals 242 shown in FIG. 2) may be disposed between the surface 236 and the outer surface of the line to help prevent or inhibit fluid leakage between the surface 236 and the line. Such fluid seals may be retained in position within corresponding circumferential grooves or channels extending along the outer and inner surfaces 238, 236.

The upper fluid seal assembly 326 may further comprise a pushing member 248 operable to selectively move axially with respect to the upper body 310, as indicated by arrows 250, 252, to selectively apply axial force (and pressure) to the fluid seal 234, thereby selectively causing the fluid seal 234 to increase and decrease contact force (and pressure) against the tapered inner surface 332 of the upper body 310 and the outer surface of the line. The pushing member 248 may comprise an inner surface 249 defining a portion of the bore 301. The pushing member 248 may be operable to push the fluid seal 234 axially along the upper body 310, as indicated by the arrow 250, to wedge the fluid seal 234 between the tapered inner surface 332 and the outer surface of the line. The pushing member 248 may be or comprise a threaded member (e.g., a nut, a bolt) operable to engage corresponding threads of the upper body 310 and to move axially with respect to the upper body 310 when rotated with respect to the upper body 310, as indicated by arrows 251. The pushing member 248 may comprise, for example, external threads configured to engage corresponding internal threads of the upper body 310 and to move axially within the cavity 331 when rotated with respect to the upper body 310.

A back-up ring 333 (e.g., an anti-extrusion ring) may be disposed within a circumferential groove or channel extending into the inner surface 332 of the upper body 310 adjacent to a lower end of the cavity 331 and/or the fluid seal 234. The back-up ring 333 may comprise an inner diameter that is smaller than the diameter of the bore 301 and slightly larger than (i.e., closely matching) an outer diameter of the line. The back-up ring 333 can substantially pack, plug, fill, or otherwise reduce an annular space between the outer surface of the line and the inner surface 332 of the upper body 310 below the cavity 331 and/or fluid seal 234. When a pressure differential is formed across the fluid seal 234, the back-up ring 333 can prevent or inhibit the fluid seal 234 and/or the elastomeric sheath covering the line from being extruded or otherwise forced into or along the annular space and, thus, damaged.

The lower fluid seal assembly 328 may be operable to fluidly seal against the inner surface 322 of the lower body 320, thereby preventing or inhibiting the wellbore fluid within the chamber 264 from entering the portion of the chamber 324 containing the line end termination device 314 when the tool string 110 is conveyed within the wellbore 102 via the line. The lower fluid seal assembly 328 may be or comprise a piston assembly slidably disposed within the chamber 324 below the line end termination device 314. The lower fluid seal assembly 328 may comprise a piston portion 346 (or a sealing portion) operable to sealingly engage the inner surface 322 of the lower body 320 to fluidly isolate the portion of the chamber 324 containing the line end termination device 314 from the chamber 264 and, thereby, prevent or inhibit the wellbore fluid within the chamber 264 from entering the portion of the chamber 324 containing the line end termination device 314 when the tool string 110 is conveyed within the wellbore 102. One or more elastomeric fluid seals 373 (e.g., O-rings, cup seals) may be disposed between the inner surface 322 and an outer surface of the piston portion 346 of the lower fluid seal assembly 328 to help prevent or inhibit fluid leakage between the lower body 320 and the lower fluid seal assembly 328. The fluid seals 373 may be retained in position within corresponding circumferential grooves or channels extending along the outer surface of the lower fluid seal assembly 328. The chamber 324 containing the line end termination device 314 may, therefore, be at least partially defined by the lower body 320 on the side and the lower fluid seal assembly 328 on the bottom. The chamber 324 containing the line end termination device 314 may be further defined by the upper body 310 and the upper fluid seal assembly 326 on the top. The lower fluid seal assembly 328 may be further operable to abut or otherwise contact the line end termination device 314. For example, the lower fluid seal assembly 328 may comprise an upper portion 348 (e.g., a tubular member or anther contact portion) configured to contact the outer shoulder 342 of the inner conical member 315.

The lower fluid seal assembly 328 may comprise opposing bulkhead connectors 374, 376 and electrical conductor 372 extending axially therethrough and configured to electrically connect the bulkhead connectors 374, 376. The bulkhead connectors 374, 376 may be configured to fluidly seal the electrical conductor 372, such as to prevent or inhibit wellbore fluid within the chamber 264 to contact the electrical conductor 372 and/or leak into the chamber 324 when the tool string 110 is conveyed within the wellbore 102. A conductor (e.g., the conductor 206 shown in FIGS. 3 and 4) of the line connected with the cable head 300 may extend through the line end termination device 314 and connect with the electrical conductor 372 via the bulkhead connector 374.

Although the lower fluid seal assembly 328 is shown slidably engaging the lower body 320, the lower fluid seal assembly 328 may instead be threadedly or otherwise fixedly and sealingly connected with the lower body 320. For example, the lower fluid seal assembly 328 may comprise external threads (not shown) configured to engage corresponding internal threads (not shown) of the lower body 320 to fixedly and sealingly engage the lower fluid seal assembly 328 with the lower body 320. Another example implementation of the cable head 300 may not comprise the lower fluid seal assembly 328, but comprise the connector 212 threadedly connected directly with the lower end of the lower body 320. Still another example implementation of the cable head 300 may not comprise the lower fluid seal assembly 328, but comprise the lower end of the lower body 320 being connected directly with a housing or body of a tool 116 of the lower portion 114 of the tool string 110.

An electrical conductor 265 may extend through the chamber 264 between the electrical bulkheads 268, 376 to electrically connect the conductors 269, 372. The electrical conductors 265, 269, 372 may, thus, electrically connect the conductor of the line with the pin connector 261 of the lower connector 212 to electrically connect the conductor of the line with the electrical conductor 115 of the lower portion 114 of the tool string 110. Thus, the bulkhead connector 268, 374, 376, the electrical conductors 265, 269, 372, and the electrical interface 260 may collectively form the electrical conductor 113, such as may facilitate electrical communication through the cable head 300.

While the tool string 110 is conveyed within the wellbore 102, a pressure differential may be formed between wellbore pressure external to the cable head 300 and internal pressure within portions of the cable head 300 between the fluid seal assemblies 326, 328, including a portion of the bore 301 and a portion of the chamber 324 containing the line end termination device 314. The fluidly isolated portions of the chamber 324 and the bore 301 may be maintained at a pressure that is substantially equal to ambient wellsite surface pressure or otherwise at a pressure that is lower than the ambient wellbore pressure. Such pressure differential may cause a downward force, as indicated by the arrow 250, to be imparted to the upper body 310 and the upper fluid seal assembly 326 with respect to the lower body 320. The pressure differential may further cause an upward force, as indicated by the arrow 252, to be imparted to the lower fluid seal assembly 328 with respect to the lower body 320. The downward force may be imparted to the line end termination device 314 via the upper body 310, which is connected to the upper conical member 317. The upward force may be imparted to the line end termination device 314 via the lower fluid seal assembly 328, which contacts the outer shoulder 342 of the inner conical member 315. Thus, the line end termination device 314 may be compressed between the upper body 310 and the lower fluid seal assembly 328 while the cable head 300 is conveyed downhole.

An outer diameter 325 of the lower fluid seal assembly 328 comprising the fluid seals 373 sealingly engaging the inner surface 322 of the lower body 320, and an outer diameter 327 of the upper body 310 comprising the fluid seals 336 sealingly engaging the inner surface 322 of the lower body 320 may be substantially equal, resulting in substantially equal downward and upward forces being imparted to the line end termination device 314. Thus, the upward and downward forces caused by the pressure differential may be equalized or balanced, such as to cancel out or negate forces caused by pressure differential within the cable head 300. Accordingly, while the tool string 110 is conveyed downhole, the upper body 310, the line end termination device 314, and the lower fluid seal assembly 328 may collectively be free to slide within the chamber 324 with respect to the lower body 320, but for the pins 350 fixedly connecting the upper and lower bodies 310, 320.

Because the line end termination device 314 is connected with the upper body 310, during downhole conveyance and other downhole operations, the line end termination device 314 is operable to connect the line with the upper body 310. The upper body 310 may be maintained in position with respect to the lower body 320 via the pins 350, which prevent the upper body 310 from moving upwardly with respect to the lower body 320. While the upper body 310 is maintained in position with respect to the lower body 320, the line end termination device 314 is maintained in the united (e.g., joined, compressed) position (or otherwise prevented from separating) and in connection with the armor wires of the line.

Figure 10:
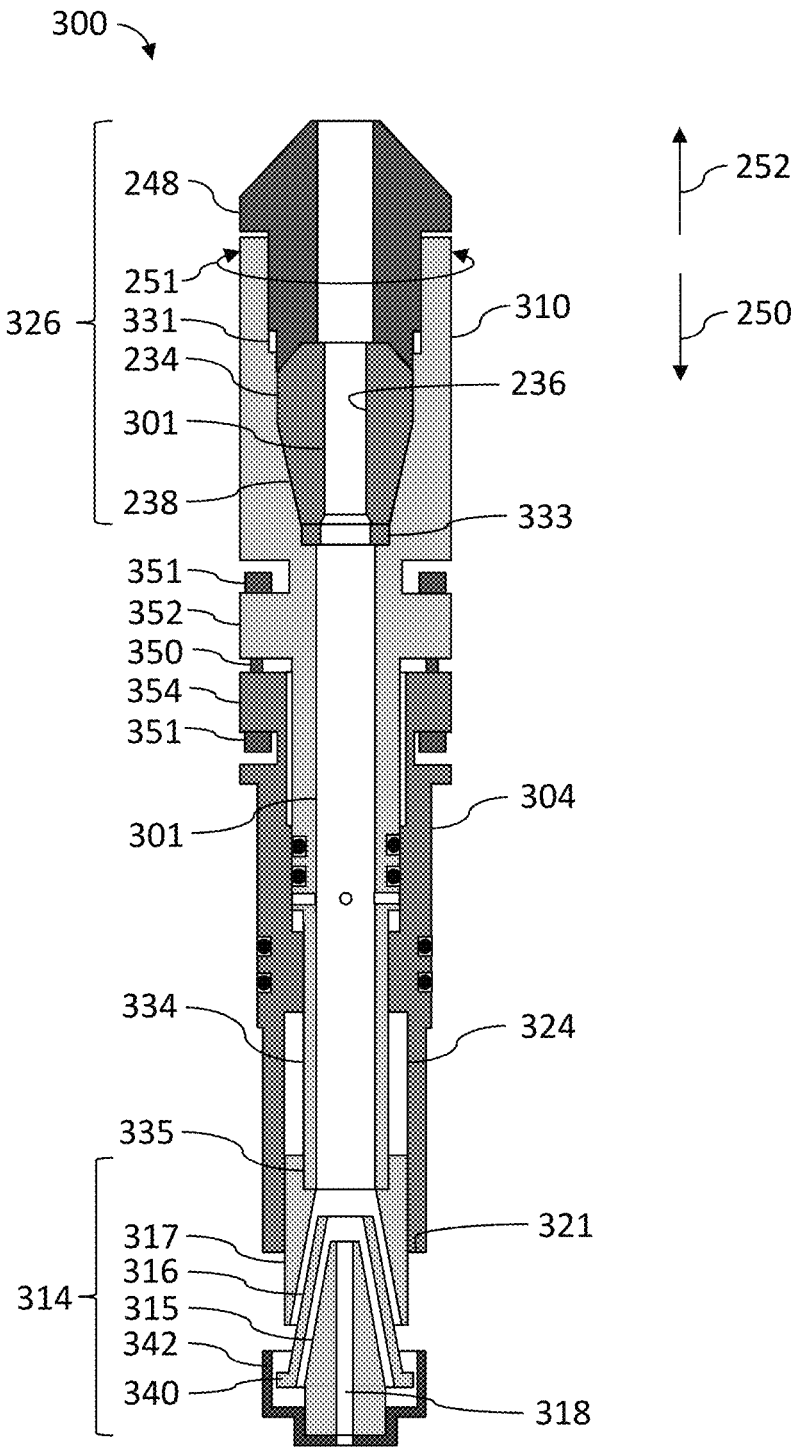
FIG. 10 is a side sectional view of the apparatus shown in FIG. 8 in a stage of assembly operations according to one or more aspects of the present disclosure.
Figure 11:
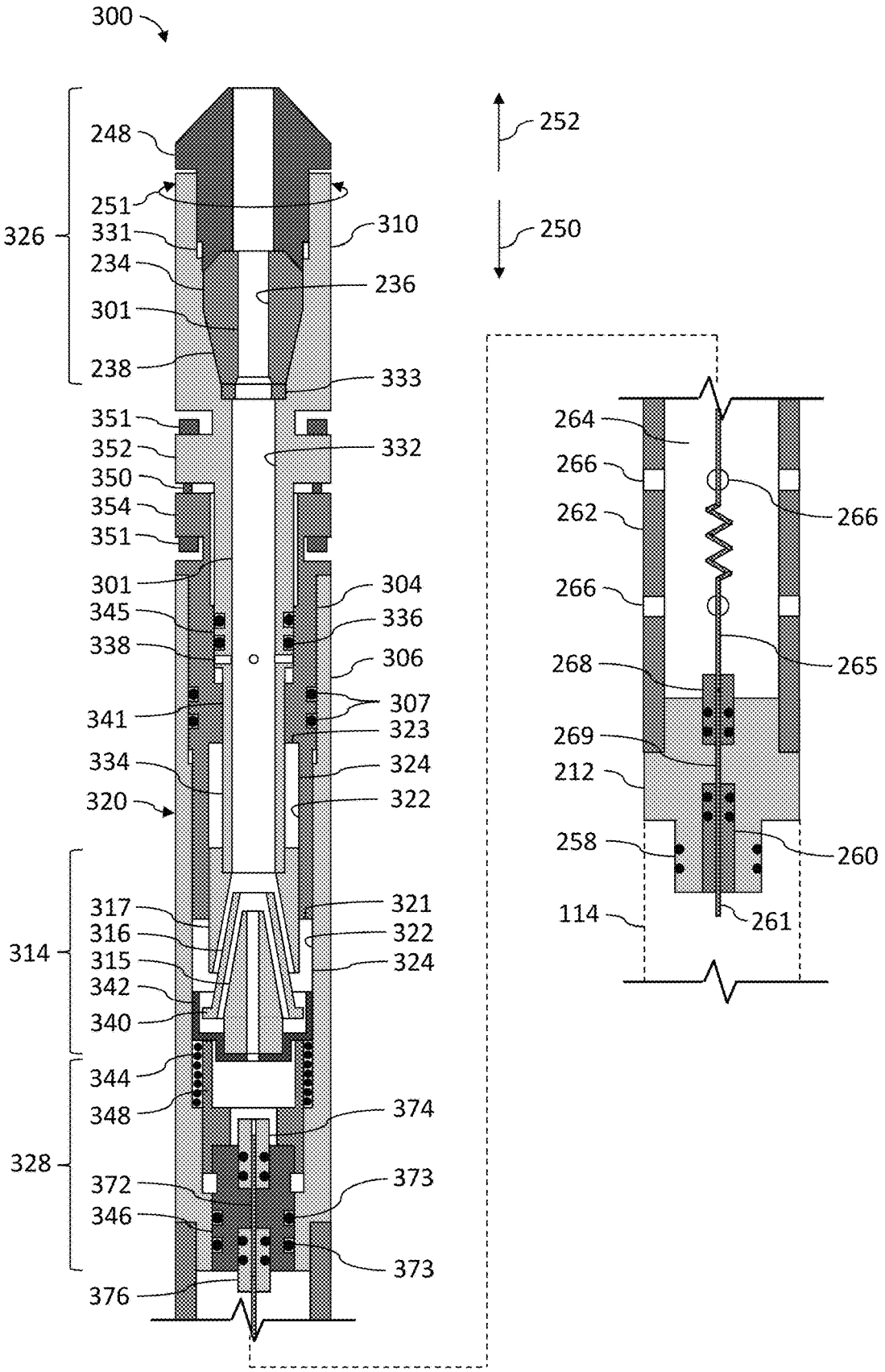
FIG. 11 is a side sectional view of the apparatus shown in FIG. 8 in another stage of assembly operations according to one or more aspects of the present disclosure.

The present disclosure is further directed to methods (e.g., steps, operations, processes) of assembling the cable head 300 shown in FIGS. 6-9. FIGS. 10 and 11 are sectional side views of the cable head 300 in various stages of assembly operations according to one or more aspects of the present disclosure. The following description refers to FIGS. 1, 10, and 11.

The cable head 300 may be assembled, for example, by inserting the upper body 310 into the lower body portion 304. The pins 350 may then be selected based on the amount of tension that is intended to cause the line to be released from the cable head 300 and inserted into the radial channels 355 to connect the flanges 352, 354 and, thereby, connect the upper and lower bodies 310, 320. The fluid seal 234 and the pushing member 248 may be inserted into the cavity 331 of the upper body 310. The line may then be passed through a bore of a weight bar (such as the weigh bar 118 shown in FIGS. 1 and 2) and through the bore 301 and chamber 324. The line may be inserted through the upper fluid seal assembly 326 before or after the upper fluid seal assembly 326 is inserted into the cavity 332. The sheath at the end of the line may be stripped, thereby exposing the armor wires. The outer layer of armor wires may be spread or distributed against an inner surface of the outer conical member 317 and the inner layer of armor wires and the conductor may be passed through the intermediate conical member 316. The inner layer of armor wires may be spread or distributed against an inner surface of the intermediate conical member 316 and the conductor may be passed through the axial bore 318 of the inner conical member 315. The inner conical member 315 may then be forced (e.g., hammered) into the intermediate conical member 316 thereby forcing the intermediate conical member 316 into the outer conical member 317 to compress the armor wires between the conical members 315, 316, 317, thereby connecting the armor wires and, thus, the line to the line end termination device 314. The outer conical member 317 may be connected to the lower portion 334 of the upper body 310 before or after the line is connected to the line end termination device 314.

The end of the line comprising the exposed armor wires connected to the line end termination device 314 may then be sealed via the fluid seal assemblies 326, 328. For example, the pushing member 248 may be rotated, as indicated by the arrow 251, to move the pushing member 248 downwardly 250 within the cavity 331 to push the fluid seal 234 downwardly, as indicated by the arrow 250, causing the fluid seal 234 to sealingly engage the outer surface of the line and, thus, fluidly isolate the bore 301 below the fluid seal 234 from the space external to the cable head 300. The downward movement of the pushing member 248 may push the fluid seal 234 downwardly to wedge the fluid seal 234 between the tapered portion of the inner surface 332 of the upper body 310 and the outer surface of the line, thereby forming a fluid seal therebetween. The pushing member 248 may, thus, impart a downward axial force, as indicated by the arrow 250, to the fluid seal 234 thereby causing the fluid seal 234 to impart a corresponding radial force against the tapered inner surface 332 and the outer surface of the line to form a fluid seal therebetween, thereby preventing or inhibiting wellbore fluid from flowing along the bore 301 toward the line end termination device 314 and the end of the line comprising the exposed armor wires. Thereafter, the conductor of the line may be electrically connected with the electrical bulkhead connector 374 of the lower fluid seal assembly 328 and the lower fluid seal assembly 328 and the biasing member 344 may be inserted into the chamber 324 of the lower body portion 306. The lower body portion 306 may then be threadedly connected with the lower body portion 304, thereby positioning the line end termination device 314 within the chamber 324 and assembling the lower body 320.

Thereafter, the conductor 265 may be electrically connected with the electrical bulkhead connector 376 of the lower fluid seal assembly 328 and with the lower connector 212. The transition housing 262 may be connected with the lower body 320 and the lower connector 212 may be connected with the transition housing 262, thereby connecting the lower connector 212 with the lower body 320. The lower portion 114 of the tool string 110 may then be connected to the lower connector 212. The weight bar may be slid along the line, inserted over the upper body 310, and threadedly connected to the lower body 310 or the lower portion 114 of the tool string 110.

The present disclosure is further directed to methods (e.g., steps, operations, processes) of operating the cable head 300 shown in FIGS. 6-9. FIGS. 11-15 are sectional side views of the cable head 300 in various stages of release operations according to one or more aspects of the present disclosure. Accordingly, the following description refers to FIGS. 1 and 11-15.

The assembled tool string 110 may be conveyed within the wellbore 102 and caused to perform intended operations via various downhole tools 116 forming the tool string 110. While conveyed downhole, the upper fluid seal assembly 326 may prevent or inhibit wellbore fluid from leaking downwardly along the bore 301 passed the fluid seal 234 into the chamber 324 containing the end of the line connected with the line end termination device 314. Similarly, the lower fluid seal assembly 328 may prevent or inhibit wellbore fluid from leaking upwardly along the chamber 324 passed the fluid seal 373 toward the end of the line connected with the line end termination device 314. Thus, the cable head 300 shown in FIG. 11 is in a connected or otherwise normal operating stage or position, in which the cable head 300 is connected to the line and utilized to transmit tension generated by the tensioning device 140 and/or winch conveyance device 144 at the wellsite surface 104 to the tool string 110, such as during downhole measuring, logging, and/or conveyance operations of the tool string 110.

Figure 12:
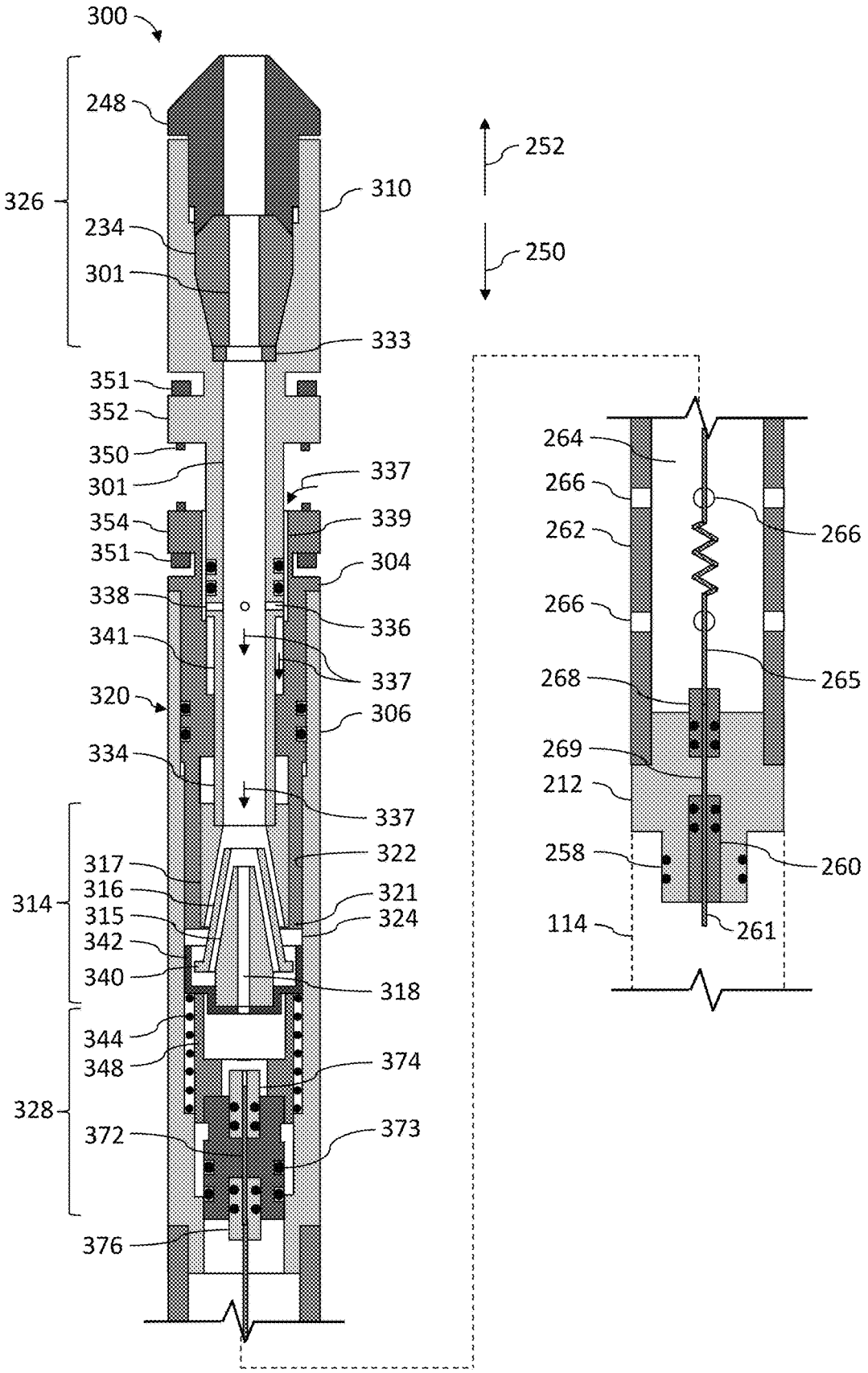
FIG. 12 is a side sectional view of the apparatus shown in FIG. 11 in a stage of release operations according to one or more aspects of the present disclosure.

When it is intended to disconnect the line from the tool string 110, such as when the tool string 110 is stuck within the wellbore 102, thereby permitting the line to be retrieved to the wellsite surface 104, the cable head 300 may be operated to release the line from the cable head 300. The cable head 300 may progress though a sequence of stages or positions during such release operations. To initiate the release of the line from the cable head 300, the tensioning device 140 and/or winch conveyance device 144 at the wellsite surface 104 may be operated to impart a tension to the line that exceeds the collective strength of the pins 350, thereby breaking the pins 350 and permitting the line to be released by the cable head 300. For example, the tension applied to the line may be transferred to the line end termination device 314, thereby urging the line end termination device 314 to move in the upward direction, as indicated by the arrow 252. The line end termination device 314, in turn, may push the upper body 310 in the upward direction with respect to the lower body 320, thereby imparting tension to the pins 350. When sufficient tension is applied by the tensioning device 140 and/or winch conveyance device 144, the pins 350 break, permitting the line end termination device 314 and the upper body 310 to move upwardly with respect to the lower body 320, as shown in FIG. 12. The upper body 310 may continue moving upwardly until the fluid ports 338 and/or the smaller diameter portion 341 of the upper body 310 reach the larger diameter portion 339 of the lower body 320, thereby permitting wellbore fluid to enter the bore 301 and the chamber 324 as indicated by arrows 337, thereby increasing the pressure therein to equalize the chamber and bore inner pressure with the wellbore pressure.

Figure 13:
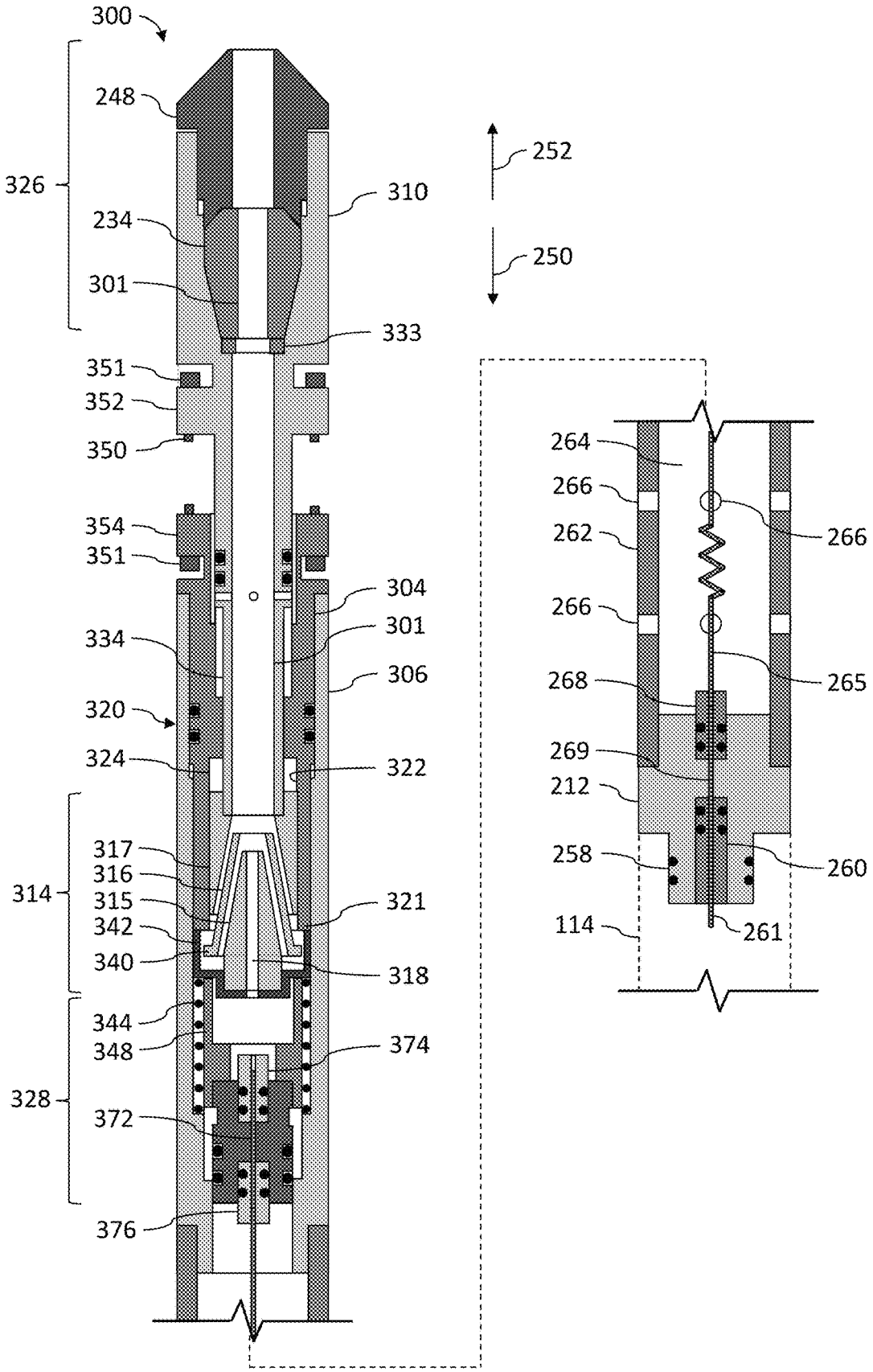
FIG. 13 is a side sectional view of the apparatus shown in FIG. 12 in another stage of release operations according to one or more aspects of the present disclosure.
Figure 14:
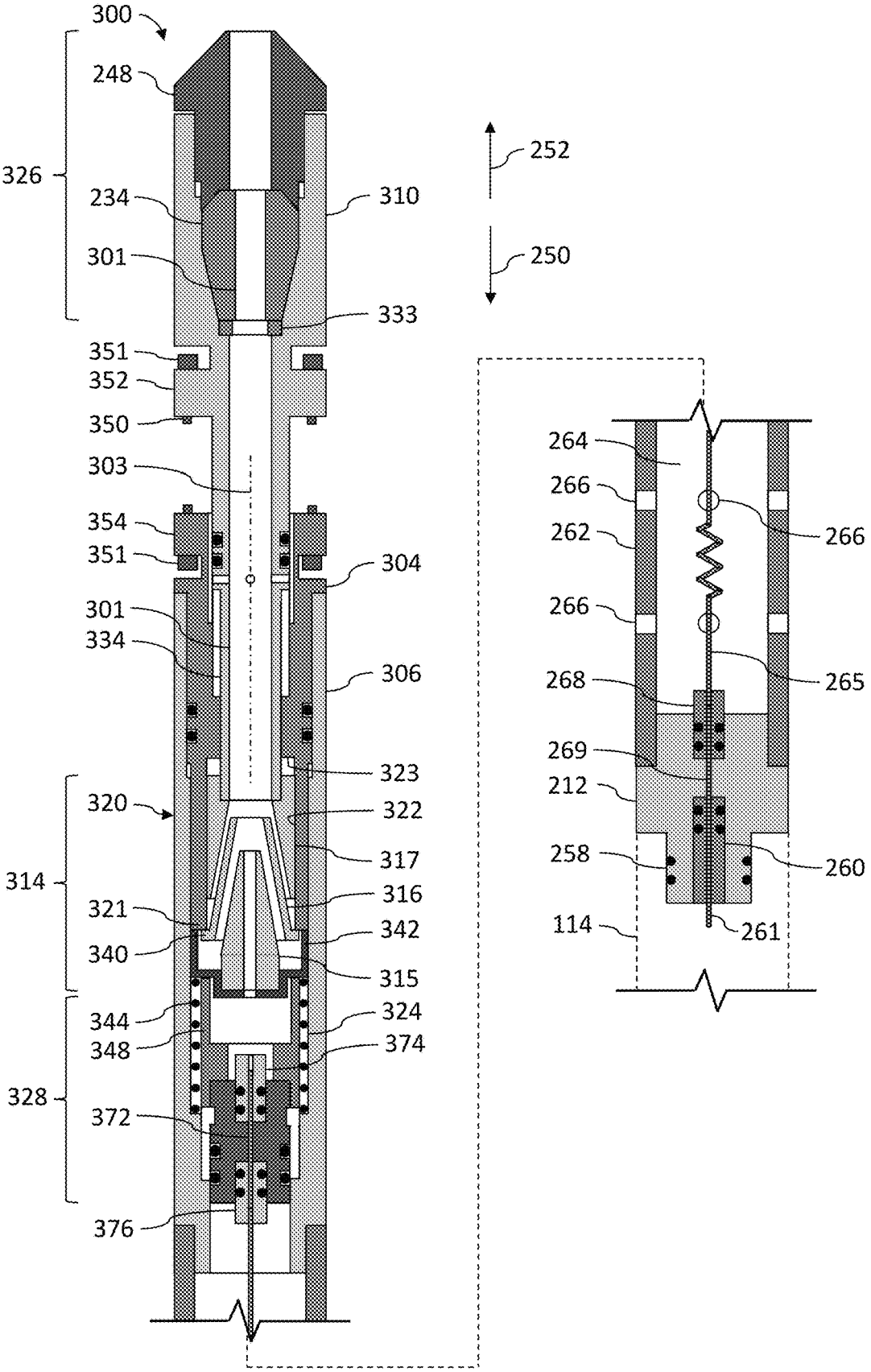
FIG. 14 is a side sectional view of the apparatus shown in FIG. 13 in another stage of release operations according to one or more aspects of the present disclosure.

The conical members 315, 316, 317 may be operable to move away from each other along a central axis 303 of the cable head 300 to release the line. As shown in FIGS. 13 and 14, the upper body 310, the line end termination device 314, and a lower fluid seal assembly 328 may continue moving upwardly until the outer shoulder 342 of the inner conical member 315 contacts the shoulder 321 of the lower body 320, thereby preventing the inner conical member 315 from moving upwardly 252 with respect to the lower body 320 while permitting the outer and intermediate conical members 317, 316 to continue moving upwardly 252 along the axis 303. Such movement causes the inner conical member 315 to separate from the intermediate conical member 316, thereby permitting the inner armor wires to be decompressed and, thus, free to be pulled out from between the inner and intermediate conical members 315, 316.

Figure 15:
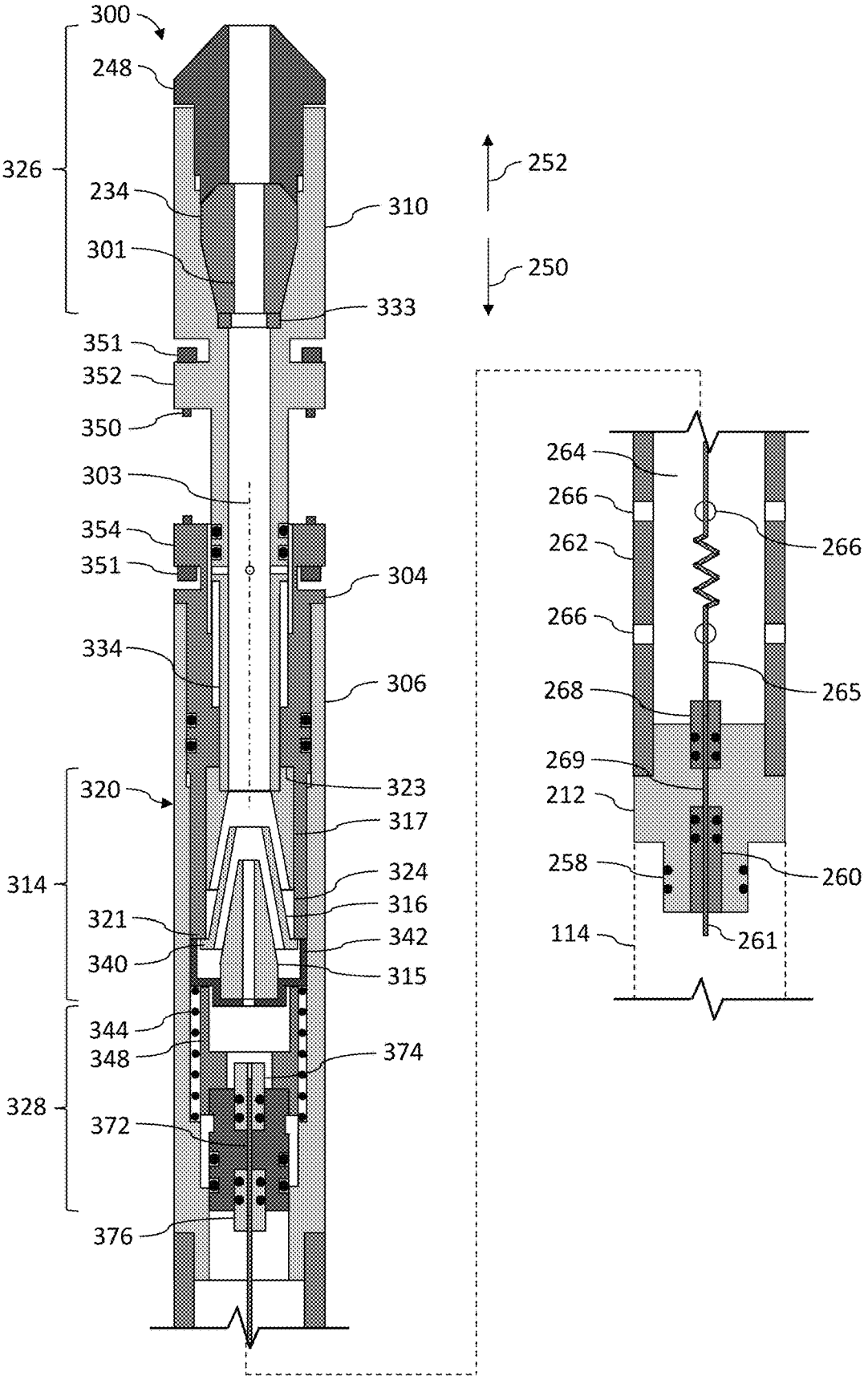
FIG. 15 is a side sectional view of the apparatus shown in FIG. 14 in another stage of release operations according to one or more aspects of the present disclosure.

As shown in FIGS. 14 and 15, the outer and intermediate conical members 317, 316 may continue to move upwardly 252 until the outer shoulder 340 of the intermediate conical member 316 contacts the shoulder 321 of the lower body 320, thereby preventing the intermediate conical member 316 from moving upwardly 252 with respect to the lower body 320 while permitting the outer conical member 317 to continue moving upwardly 252 along the axis 303. Such movement causes the intermediate conical member 316 to separate from the outer conical member 317, thereby permitting the outer armor wires to be decompressed and, thus, free to be pulled out from between the intermediate and outer conical members 316, 317. The upper body 310 and the outer conical member 317 may continue to move upwardly 252 until the outer conical member 317 contacts an inner shoulder 323 of the lower body 320, thereby preventing the upper body 310 from detaching from the lower body 320. With the pressure differential between the chamber 324, the bore 301, and the wellbore equalized, the line may be free to be moved upwardly along the bore 301 to pull the armor wires out of the line end termination device 314. The line may then be pulled through the fluid seal 234, overcoming the friction against the fluid seal 234, out of the cable head 300, and retrieved to the wellsite surface 104.

Fishing equipment (not shown) may then be deployed downhole and coupled or otherwise engaged with the tool string 110 left in the wellbore 102, such as may permit fishing operations to be employed to free the tool string 110. The fishing equipment may engage a neck, a profile, or an outer surface of the weight bar, the cable head 300, and/or another portion of the tool string 110.

Although FIGS. 1-15 show the cable heads 112, 200, 300 comprising certain features in specific combinations, it is to be understood that a cable head according to one or more aspects of the present disclosure may comprise one or more features shown in FIGS. 1-15, but in different combinations than as shown in FIGS. 1-15 and/or described herein. Accordingly, the current disclosure is further directed to a cable head comprising one or more features, but not necessarily every feature, of the cable heads 112, 200, 300 shown in one or more of FIGS. 1-15.

An example implementation of a cable head according to one or more aspects of the present disclosure may include the upper fluid seal assembly 226, 326, but may not include the lower fluid seal assembly 228, 328 nor the body assembly comprising an upper body 226, 326 and a lower body 228, 328 connected together via a plurality of pins 286, 350 and operable to be moved with respect to each other when predetermined tension is applied to the line from the wellsite surface 104. Such example implementation of the cable head may comprise the line end termination device 214, 314 or another line end termination device (e.g., an eye, an open socket, a closed socket, a thimble, a button, a permanent wedge socket assembly, a swaged sleeve or stud, a permanent sleeve, plug, and socket assembly, etc.) that is not operable to release the line while downhole via the release operations described herein. Such example implementation of the cable head may comprise the connector 212 threadedly engaged directly with a lower end of the lower body 220, 320, or such example implementation of the cable head may comprise a lower end of the lower body 320 connected directly with a housing or body of a tool 116 (e.g., a CCL) of the lower portion 114 of the tool string 110, thereby fluidly isolating the chamber 224, 324 from the wellbore fluid. Such example implementation of the cable head may comprise a body assembly comprising the upper body 226, 326 and the lower body 228, 328 fixedly connected together such that the upper body 226, 326 and the lower body 228, 328 are not movable with respect to each other when tension is applied to the line from the wellsite surface 104. For example the upper body 226, 326 and the lower body 228, 328 may be connected together by corresponding threads and/or a plurality of bolts. The upper body 226, 326 and the lower body 228, 328 may instead be integrally formed. Such example implementation of the cable head may, thus, be operable to fluidly seal against a line (e.g., a cable comprising an outer elastomeric sheath) to prevent or inhibit wellbore fluid from entering the chamber 224, 324 containing the line end termination device, thereby preventing or inhibiting the wellbore fluid from entering the line beneath the sheath and migrating upward along the line. Such cable head, however, may not be operable to perform the line release operations described herein.

Another example implementation of a cable head according to one or more aspects of the present disclosure may include the line end termination device 214, 314, and the body assembly comprising the upper body 226, 326 and the lower body 228, 328 connected together via the pins 286, 350 and operable to be moved with respect to each other when predetermined tension is applied to the line from the wellsite surface 104. However, such example implementation of the cable head may not include the upper fluid seal assembly 226, 326 nor the lower fluid seal assembly 228, 328. Such example implementation of the cable head may comprise the connector 212 threadedly engaged directly with a lower end of the lower body 220, 320, or such example implementation of the cable head may comprise the lower end of the lower body 320 connected directly with a housing or body of a tool 116 (e.g., a CCL) of the lower portion 114 of the tool string 110. Such example implementation of the cable head may, thus, be operable to perform the line release operations described herein to release the line when the predetermined tension is applied to the line from the wellsite surface 104, but may not prevent or inhibit wellbore fluid from entering the chamber 224, 324 containing the line end termination device 214, 314. Such example implementation of the cable head may be used with lines that do not include an outer elastomeric cover or sheath, such as a wire rope, a braided line (i.e., braded cable), or a slickline, among other examples. Such example implementation of the cable head may be used with lines that include an electrical conductor and with lines that do not include an electrical conductor.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a downhole tool operable to connect with a line, wherein the downhole tool comprises:

a body configured to receive the line;

a fluid seal operable to seal against the line when the downhole tool is connected with the line to inhibit wellbore fluid from entering at least a portion of the body when the downhole tool is conveyed within a wellbore via the line; and a line end termination device disposed in a chamber within the body, wherein the line end termination device is operable to connect with the line, wherein the fluid seal inhibits the wellbore fluid from entering the chamber when the downhole tool is conveyed within the wellbore via the line, and wherein the line end termination device is operable to release the line when a predetermined tension is applied to the line from a wellsite surface.

2. The apparatus of claim 1 wherein:

the downhole tool further comprises an inwardly tapered inner surface defining a cavity;

at least a portion of the fluid seal is disposed within the cavity against the inwardly tapered inner surface; and the fluid seal comprises:

an inner surface defining a bore configured to accommodate the line therethrough, wherein the inner surface of the fluid seal is configured to seal against the line when the downhole tool is connected with the line; and an inwardly tapered outer surface configured to seal against the inwardly tapered inner surface defining the cavity.

3. The apparatus of claim 2 wherein the downhole tool further comprises a pushing member operable to push the fluid seal to cause the fluid seal to be wedged between the inwardly tapered inner surface and the line thereby causing the fluid seal to seal against the inwardly tapered inner surface and the line, and wherein the pushing member comprises a threaded member operable to move axially along the cavity when rotated.

4. The apparatus of claim 1 wherein:

the downhole tool further comprises an inner surface defining a cavity;

at least a portion of the fluid seal is disposed within the cavity against the inner surface;

the downhole tool further comprises a pushing member operable to apply pressure to the fluid seal thereby causing the fluid seal to seal against the inner surface and the line; and the pushing member comprises a threaded member operable to move axially along the cavity when rotated.

5. The apparatus of claim 1 wherein:

the fluid seal is a first fluid seal;

the downhole tool further comprises a fluid seal assembly comprising:

the first fluid seal; and a second fluid seal sealingly engaging an inner surface of the body;

the first fluid seal and the second fluid seal collectively inhibit the wellbore fluid from entering the chamber when the downhole tool is conveyed within the wellbore via the line; and at least a portion of the fluid seal assembly is slidably disposed within the body.

6. The apparatus of claim 5 wherein:

the fluid seal assembly is a first fluid seal assembly;

the downhole tool further comprises a second fluid seal assembly slidably disposed within the body;

the second fluid seal assembly comprises a third fluid seal sealingly engaging the inner surface of the body;

the first fluid seal, the second fluid seal, and the third fluid seal collectively inhibit the wellbore fluid from entering the chamber when the downhole tool is conveyed within the wellbore via the line; and the first fluid seal assembly and the second fluid seal assembly are located on opposing sides of the line end termination device.

7. The apparatus of claim 6 wherein the second fluid seal assembly is operable to impart a force caused by wellbore pressure to the line end termination device when the downhole tool is conveyed within the wellbore.

8. An apparatus comprising:

a downhole tool operable to connect with a line, wherein the downhole tool comprises:

a body configured to receive the line;

a first fluid seal slidably disposed within the body and operable to seal against an inner surface of the body to inhibit wellbore fluid from entering at least a portion of the body when the downhole tool is conveyed within a wellbore via the line;

a second fluid seal operable to seal against the line when the downhole tool is connected with the line to inhibit the wellbore fluid from entering at least a portion of the body when the downhole tool is conveyed within the wellbore via the line; and a line end termination device disposed in a chamber within the body, wherein the first fluid seal and second fluid seal are operable to inhibit the wellbore fluid from entering the chamber when the downhole tool is conveyed within the wellbore via the line, and wherein the line end termination device is operable to:

connect with the line; and release the line when a predetermined tension is applied to the line from a wellsite surface.

9. The apparatus of claim 8 wherein:
the downhole tool further comprises a fluid seal assembly comprising the first fluid seal;
at least a portion of the fluid seal assembly is slidably disposed within the body; and
the first fluid seal and the second fluid seal are located on opposing sides of the line end termination device.

10. The apparatus of claim 9 wherein the fluid seal assembly is operable to impart a force caused by wellbore pressure to the line end termination device when the downhole tool is conveyed within the wellbore.

11. An apparatus comprising:
a downhole tool operable to connect with a line, wherein the downhole tool comprises:
a body assembly comprising a first body and a second body, wherein:
the first body comprises an opening configured to receive the line;
the second body comprises a bore extending therethrough; and
the first body comprises a piston portion slidably disposed within the bore;
a piston assembly slidably disposed within the bore;
a fluid seal operable to seal against the line when the downhole tool is connected with the line; and
a line end termination device disposed within the bore between the piston portion of the first body and the piston assembly, wherein the line end termination device is operable to connect with the line, and wherein the fluid seal, the piston portion of the first body, and the piston assembly each inhibit wellbore fluid from entering at least a portion of the bore containing the line end termination device when the downhole tool is conveyed within a wellbore via the line.

12. The apparatus of claim 11 wherein:
the piston portion of the first body comprises an outer diameter;
the piston assembly comprises an outer diameter; and
the outer diameter of the piston portion of the first body and the outer diameter of the piston assembly are substantially equal.

13. The apparatus of claim 11 wherein the first body carries the fluid seal.

14. The apparatus of claim 11 wherein:
the fluid seal is a first fluid seal;
the first body comprises:
the first fluid seal; and
a second fluid seal sealingly engaging an inner surface of the second body defining the bore; and
the piston assembly further comprises a third seal sealingly engaging the inner surface of the second body.

15. An apparatus comprising:
a downhole tool operable to connect with a line, wherein the downhole tool comprises:
a body configured to receive the line, wherein the body comprises a first body and a second body;
a fluid seal operable to seal against the line when the downhole tool is connected with the line to inhibit wellbore fluid from entering at least a portion of the body when the downhole tool is conveyed within a wellbore via the line; and
a line end termination device disposed in a chamber within the body, wherein the line end termination device is operable to connect with the line, wherein the fluid seal inhibits the wellbore fluid from entering the chamber when the downhole tool is conveyed within the wellbore via the line, and wherein the first body is operable to move with respect to the second body when a predetermined tension is applied to the line from a wellsite surface to cause the line end termination device to release the line.

16. The apparatus of claim 15 wherein, after the downhole tool is connected with the line and conveyed within the wellbore via the line, the first body and the second body:
contact the wellbore fluid; and
fluidly isolate the line end termination device from the wellbore fluid.

17. The apparatus of claim 16 wherein the first body and the second body are fixedly connected until the predetermined tension is applied to the line from the wellsite surface to cause the first body to move with respect to the second body.

18. The apparatus of claim 16 wherein the first body and the second body are fixedly connected via a plurality of breakable members that are configured to break when the predetermined tension is applied to the line to permit the first body to move with respect to the second body.

19. An apparatus comprising:
a downhole tool operable to connect with a line, wherein the downhole tool comprises:
a body configured to receive the line, wherein the body comprises:
a first body having an opening configured to receive the line, wherein the first body carries a fluid seal operable to seal against the line when the downhole tool is connected with the line to inhibit wellbore fluid from entering at least a portion of the body when the downhole tool is conveyed within a wellbore via the line, and wherein the first body comprises a piston portion; and
a second body comprising an inner surface defining a bore extending through the second body;
a piston assembly slidably disposed within the bore, wherein the piston portion of the first body is slidably disposed within the bore, and wherein an outer diameter of the piston assembly and an outer diameter of the piston portion of the first body are substantially equal; and
a line end termination device disposed within the bore between the first body and the piston assembly, wherein the line end termination device is operable to connect with the line.

20. The apparatus of claim 19 wherein the piston assembly is operable to impart a force caused by wellbore pressure to the line end termination device when the downhole tool is conveyed within the wellbore.

21. The apparatus of claim 19 wherein:
the fluid seal is a first fluid seal;
the first body carries a second fluid seal sealingly engaging the inner surface of the second body; and
the piston assembly further comprises a third seal sealingly engaging the inner surface of the second body.

22. An apparatus comprising:
a downhole tool operable to connect with a line, wherein the downhole tool comprises:
a body configured to receive the line;
a first fluid seal slidably disposed within the body and operable to seal against an inner surface of the body to inhibit wellbore fluid from entering at least a portion of the body when the downhole tool is conveyed within a wellbore via the line;
a second fluid seal operable to seal against the line when the downhole tool is connected with the line to inhibit the wellbore fluid from entering at least a portion of the body when the downhole tool is conveyed within the wellbore via the line; and a line end termination device disposed in a chamber within the body, wherein the first fluid seal and second fluid seal are operable to inhibit the wellbore fluid from entering the chamber when the downhole tool is conveyed within the wellbore via the line, wherein the line end termination device is operable to connect with the line, wherein the body comprises a first body and a second body, and wherein the first body is operable to move with respect to the second body when a predetermined tension is applied to the line from a wellsite surface to cause the line end termination device to release the line.

23. The apparatus of claim 22 wherein, after the downhole tool is connected with the line and conveyed within the wellbore via the line, the first body and the second body:

contact the wellbore fluid; and fluidly isolate the line end termination device from the wellbore fluid.

24. The apparatus of claim 23 wherein the first body and the second body are fixedly connected until the predetermined tension is applied to the line from the wellsite surface to cause the first body to move with respect to the second body.

25. The apparatus of claim 23 wherein the first body and the second body are fixedly connected via a plurality of breakable members that are configured to break when the predetermined tension is applied to the line to permit the first body to move with respect to the second body.

26. An apparatus comprising:

a downhole tool operable to connect with a line, wherein the downhole tool comprises:

a body comprising:

a first body comprising an opening configured to receive the line; and a second body, wherein at least a portion of the first body is slidably disposed within the second body, and wherein the first body comprises a sealing portion fluidly sealing against an inner surface of the second body;

a fluid seal slidably disposed within the second body and operable to seal against the inner surface of the second body; and a line end termination device operable to connect with the line, wherein the line end termination device is disposed within the second body between the sealing portion of the first body and the fluid seal, wherein the sealing portion of the first body and the fluid seal inhibit wellbore fluid from entering at least a portion of the second body containing the line end termination device when the downhole tool is conveyed within a wellbore via the line.

27. The apparatus of claim 26 wherein:

the sealing portion of the first body comprises an outer diameter;

the fluid seal comprises an outer diameter; and the outer diameter of the sealing portion of the first body and the outer diameter of the fluid seal are substantially equal.

28. The apparatus of claim 26 wherein the first body, the line end termination device, and the fluid seal are collectively movable with respect to the second body when the downhole tool is conveyed within the wellbore and a predetermined tension is applied to the line from a wellsite surface to cause the line end termination device to release the line.

29. The apparatus of claim 26 wherein:

the downhole tool further comprises a fluid seal assembly comprising the fluid seal;

the fluid seal assembly is slidably disposed within the second body; and the fluid seal assembly is operable to impart a force caused by wellbore pressure to the line end termination device when the downhole tool is conveyed within the wellbore.

30. The apparatus of claim 26 wherein, after the downhole tool is connected with the line and conveyed within the wellbore via the line, the first body and the second body:

contact the wellbore fluid; and fluidly isolate the line end termination device from the wellbore fluid.

* * * * *